US008282412B1

(12) United States Patent
Yaguchi et al.

(10) Patent No.: US 8,282,412 B1
(45) Date of Patent: Oct. 9, 2012

(54) FLAT CABLE AND CONNECTION STRUCTURE BETWEEN FLAT CABLE AND PRINTED WIRING BOARD

(75) Inventors: Akihiro Yaguchi, Kasama (JP); Takumi Kobayashi, Hitachi (JP); Kenichi Murakami, Hitachi (JP); Hiroaki Komatsu, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/137,330

(22) Filed: Aug. 5, 2011

(30) Foreign Application Priority Data

Apr. 28, 2011 (JP) ..... 2011-100524

(51) Int. Cl.
*H01R 12/24* (2006.01)

(52) U.S. Cl. ..... 439/492

(58) Field of Classification Search ..... 439/492, 439/496, 493, 495, 499
See application file for complete search history.

(56) References Cited

U.S. PATENT DOCUMENTS 7,189,105 B2 * 3/2007 Takaku et al. ..... 439/497
7,344,852 B1 * 3/2008 Aertgeerts et al. ..... 435/24
7,789,678 B2 * 9/2010 Nagata et al. ..... 439/108
7,988,465 B2 * 8/2011 Chuo et al. ..... 439/98
2009/0221165 A1 * 9/2009 Buck et al. ..... 439/108
2010/0081334 A1 * 4/2010 Kagotani ..... 439/639

FOREIGN PATENT DOCUMENTS

JP 8-203577 A 8/1996
JP 2001-143784 A 5/2001
JP 2002-216873 A 8/2002

* cited by examiner

*Primary Examiner* — Tulsidas C Patel
*Assistant Examiner* — Phuongchi Nguyen
(74) *Attorney, Agent, or Firm* — McGinn IP Law Group, PLLC

(57) ABSTRACT

A flat cable includes a plurality of conductors arranged in parallel, an insulating member covering the plurality of conductors, a first reinforcing member on a surface of an end portion of the insulating member, and a second reinforcing member on an opposite side of the first reinforcing member across the conductor and the insulating member. The first reinforcing member includes a reinforcing metal plate including an end portion bent toward the second reinforcing member, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member. The second reinforcing member has a rigidity greater than that of the covering member of the first reinforcing member.

12 Claims, 16 Drawing Sheets

3b BENT CONDUCTOR PORTION
3c CONDUCTOR-SOLDER CONNECTING PORTION
11a EXPOSED METAL PLATE PORTION
11b BENT METAL PLATE PORTION
11c METAL PLATE INSERTION PORTION
20 SECOND REINFORCING MEMBER

3a EXPOSED CONDUCTOR PORTION
11a EXPOSED METAL PLATE PORTION

3 CONDUCTOR
3a EXPOSED CONDUCTOR PORTION
11 REINFORCING METAL PLATE
12 COVERING MEMBER

3a EXPOSED CONDUCTOR PORTION
3b BENT CONDUCTOR PORTION
3c CONDUCTOR-SOLDER CONNECTING PORTION

FLAT CABLE AND CONNECTION STRUCTURE BETWEEN FLAT CABLE AND PRINTED WIRING BOARD

The present application is based on Japanese Patent Application No. 2011-100524 filed on Apr. 28, 2011, the entire contents of which are incorporated herein by reference.

BACKGROUND OF THE INVENTION

1. Field of the Invention

The invention relates to a flat cable, and a connection structure between a flat cable and a printed wiring board.

2. Description of the Related Art

Conventionally, a wire harness is used as a wiring component for electrically connecting plural printed wiring boards which are mounted inside, e.g., an on-vehicle inverter unit or an engine control unit, and a connection structure using a connector component is employed for connection between the wire harness and the printed wiring board. In recent years, use of an alternative wiring component in place of wire harness, an application of a connection method not using a connector component and simplification of connection process are required as a measure of realizing both downsizing/thinning of and cost reduction of on-vehicle devices.

In order to respond to such downsizing and cost reduction of on-vehicle devices, an inter-board connection structure has been proposed in which a flat cable called FFC (Flexible Flat Cable) including plural conductors arranged in parallel, e.g., a conductor potion formed of a Cu alloy (oxygen-free copper, tough pitch copper), which are integrated by adhesively covering a covering insulation film using an adhesive material from both sides of the conductor portion in a thickness direction is employed as a wiring component used in an on-vehicle device. In the FFC, a exposed conductor portion which is exposed from the insulation film is formed at both longitudinal ends of the conductor, and is connected to an electrode section of a printed wiring board. And also, MFJ (Multi Frame Joiner) and FPC (Flexible Print Circuit), etc., are employed for a flat cable used as a wiring component in an on-vehicle device.

For connection between the exposed conductor portion of the flat cable and the electrode section provided on the printed wiring board, a structure of direct connection using a joining material such as solder material or conductive adhesive material not through a connector may be employed. A direct connection using a solder material, etc., allows not only downsizing in accordance with a decrease in a connecting area and reduction of the number of connecting parts but also reduction or simplification of attachment processes by simultaneously performing the direct connection with solder connection of electronic component attached to the printed wiring board other than the wiring component.

On the other hand, high durable reliability for long time use has been required for on-vehicle devices. Ensuring of reliability against long-term vibration load or thermal load is also vital for a wiring component attached to an on-vehicle device or a connecting portion thereof. In a wiring component for connecting plural printed wiring boards, mechanical load repeatedly acts on a connecting portion of the wiring component due to, resonant vibration of the wiring component itself, etc., caused by vibration load acting on the on-vehicle device. There is a high possibility that a fatigue fracture occurs at the connecting portion of the wiring component due to the mechanical load, hence, it is especially important to ensure reliability against vibration load in a wiring component for on-vehicle devices.

Ensuring of long-term reliability is vital for on-vehicle devices, and a flat cable itself and a connecting portion thereof are also required to ensure reliability against vibration load or thermal load. Particularly, reliability against mechanical load such as vibration or impact is important for on-vehicle devices which are mounted inside an engine compartment. In order to improve reliability, it is necessary to optimize the entire structure of the on-vehicle device and also to study a structure or means which reduces mechanical load applied to the connecting portion of the flat cable and improves resistance against mechanical load.

The inter-board wiring component to connect a exposed conductor portion of a flat cable to an electrode section of a printed wiring board using a solder material has a structure in which load is likely to be applied to the vicinity of the connecting portion of the exposed conductor portion. Large stress is concentrated especially on a exposed conductor portion at a covering material end portion or an upper end portion of a solder connection fillet at the tip of the exposed conductor portion.

When mechanical load, especially high amplitude mechanical load in a thickness direction of the flat cable (a direction to separate a connection interface between the electrode section of the printed wiring board and the exposed conductor portion of the flat cable) acts on the connecting portion between the electrode section of the printed wiring board and the exposed conductor portion of the flat cable, fracture or separation of the connecting portion or breaking of the exposed conductor portion of the flat cable may occur.

As a method of reducing mechanical load applied to the connecting portion between the exposed conductor portion of the flat cable and the electrode section of the printed wiring board, a method is suggested in which a flat wiring material restricting clip is provided to restrict a flat wiring material such as FFC or FPC to a circuit board and the flat wiring material is pressed down on the circuit board at a portion closer to the edge of the circuit board than to the conductor end portion of the flat wiring material by the flat wiring material restricting clip in a state that the conductor of the flat wiring material is connected to the circuit board (see, e.g., JP-A-2001-143784).

According to the means of pressing down the flat wiring material on the circuit board by the flat wiring material restricting clip in a state that the conductor of the flat wiring material is connected to the circuit board as disclosed in JP-A-2001-143784, when an external mechanical force in a separating direction is applied to the connecting portion of the flat wiring material, it is possible to prevent the external mechanical force from acting on the connecting portion by restriction of the flat wiring material restricting clip. As a result, it is possible to prevent damage to the connecting portion between the circuit board and the flat wiring material.

Meanwhile, as a means of reinforcing a connecting portion between a conductor of a flat cable and a circuit of a printed wiring board, a method is suggested in which adhesion between the flat cable and the printed wiring board is enhanced to reinforce the connecting portion therebetween (see, e.g., JP-A-H8-203577). According to this conventional method, a right-angle bent portion is formed on a conductor at an end portion of the FFC and an end portion of the conductor of the FFC is inserted into a hole formed on a corresponding circuit of the printed wiring board (FPC, etc.). Then, the conductor of the FFC is fixed to the back surface of the FPC by pressure bonding or soldering and is reinforced from both sides of the conductor by plastic reinforcing plates or by holding with an adhesive tape.

According to the means of reinforcing the connecting portion between the conductor of the flat cable and the circuit of the printed wiring board as disclosed in JP-A-H8-203577, the reinforcing plates sandwich or the adhesive tape is wound multiple times around the flat cable as well as the printed wiring board from both upper and lower sides to fix the conductor of the flat cable to the circuit of the printed wiring board at the connecting portion, and it is thereby possible to reduce external mechanical force which acts on the connecting portion.

In addition, as a means of connecting and fixing a flat cable or a cable of a flexible wiring board, etc., to a printed wiring board, a method in which a fixing plate (a plate formed of metal) for applying pressure to a cable placed on a printed wiring board is provided at an upper portion of the cable and is fixed to the printed wiring board by a screw, or a method in which a cable is fixed to a printed wiring board by inserting a terminal having a claw formed at a tip thereof into a hole provided on the printed wiring board is suggested (see, e.g., JP-A-2002-216873).

According to the means of fixing a flat cable or a cable of a flexible wiring board to a printed wiring board as disclosed in JP-A-2002-216873, the fixing board which covers the connecting portion between a conductor of the cable and the printed wiring board can be fixed to the printed wiring board by a terminal having a claw formed at a tip thereof, and it is thereby possible to reduce external mechanical force which acts on the connecting portion.

SUMMARY OF THE INVENTION

However, the method disclosed in JP-A-2001-143784 has a structure in which the flat wiring material restricting clip is formed by bending a single rod and the flat wiring material is pressed against the circuit board by an elastic deformation force (spring force) of a portion which is bent into a shape of sandwiching the circuit board. There is a concern that the elastic deformation force of the flat wiring material restricting clip gradually deteriorates due to mechanical load such as vibration which is repeatedly applied for long term. It is believed that an external mechanical force in a separating direction which acts on the connecting portion of the flat wiring material is gradually increased due to deterioration in the elastic deformation force, i.e., restricting force, leading to damage at some stage.

Meanwhile, the structure disclosed in JP-A-H8-203577 is to reinforce by covering the connecting portion together with the flat cable and the printed wiring board, hence, an area for providing a reinforcing plate or an adhesive tape becomes larger than the width of the flat cable or the width of the printed wiring board, which is a cause of impeding the downsizing of the connecting portion.

In addition, in the technique disclosed in JP-A-H8-203577, it is configured to reinforce the connecting portion by a plastic reinforcing plate or an adhesive tape. It is anticipated that the plastic reinforcing plate does not have enough rigidity against mechanical load when being mounted on an on-vehicle device, and a sufficient load suppression effect may not be obtained. A reinforcement effect may be decreased by softening of the plastic plate or deterioration in adhesive properties (or tack strength) of the adhesive tape caused by continuous exposure of the on-vehicle device to high temperature for long time and sufficient suppression effect may not be obtained, neither.

Furthermore, in the means disclosed in JP-A-2002-216873, it is anticipated that looseness occurs at a fixed portion between the screw or the terminal having a claw formed at a tip thereof and the printed wiring board due to the mechanical load such as vibration which is repeatedly applied for long term. The looseness lowers the restricting force of the fixing board and increases the external mechanical force acting on the connecting portion of the cable conductor, which may lead to damage to the conductor of the cable.

In addition, for connecting the exposed conductor portion of the flat cable to the electrode of the printed wiring board, there is a case to use a structure in which an S-shaped (gull-wing shaped) bent portion is formed on the exposed conductor portion and the tip portion of the bent portion is placed on and solder-connected to the electrode of the printed wiring board. In this connection structure, a gap is generated between a lower surface of the flat cable (a surface facing the printed wiring board) and an upper surface of the printed wiring board at a root portion of a film of the exposed conductor portion.

When the technique disclosed in JP-A-2001-143784 is used in a state that a gap is present between the flat cable and the printed wiring board in the vicinity of the connecting portion, it is anticipated that the flat cable is deformed toward the printed wiring board (deformed in a direction to narrow the gap) due to the elastic deformation force (spring force) of the flat wiring material restricting clip. Such deformation generates mechanical stress in the solder-connecting portion of the exposed conductor portion or in the conductor at the film edge, and the mechanical stress generation portion may be damaged by the load such as vibration further acting thereon in a state that the mechanical stress has been already continuously applied for long period of time.

In addition, since the technique disclosed in JP-A-H8-203577 is also a structure to press the flat cable against the printed wiring board by a reinforcing plate or an adhesive tape, the same problem as JP-A-2001-143784 may occur. Furthermore, since the technique disclosed in JP-A-2002-216873 is also a structure to press the cable conductor connecting portion against the printed wiring board by a fixing plate formed of metal, the same problem as the techniques disclosed in JP-A-2001-143784 and JP-A-H8-203577 may occur. Thus, in the conventional connecting methods disclosed in JP-A-2001-143784, JP-A-H8-203577 and JP-A-2002-216873, there is a concern that the restricting force decreases due to mechanical load such as vibration for long time or impact or that the flat cable is deformed.

Therefore, it is an object of the invention to provide a flat cable and a connection structure between a flat cable and a printed wiring board in which, for connecting a exposed conductor portion of a flat cable to a corresponding electrode section formed on a printed wiring board by a solder material, it is possible to ensure stable connection reliability against mechanical load such as vibration or impact without causing fracture or damage to a connecting portion.

(1) According to one embodiment of the invention, a flat cable comprises:

a plurality of conductors arranged in parallel;

an insulating member covering the plurality of conductors;

a first reinforcing member on a surface of an end portion of the insulating member; and a second reinforcing member on an opposite side of the first reinforcing member across the conductor and the insulating member, wherein the first reinforcing member comprises a reinforcing metal plate comprising an end portion bent toward the second reinforcing member, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member, and wherein the second reinforcing member has a rigidity greater than that of the covering member of the first reinforcing member.

In the above embodiment (1) of the invention, the following modifications and changes can be made.

(i) The second reinforcing member comprises a reinforcing metal plate, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member.

(ii) The second reinforcing member comprises a covering member thicker than the covering member of the first reinforcing member, and an adhesive interposed between the covering member of the second reinforcing member and the insulating member to bond therebetween.

(iii) The reinforcing metal plate of the second reinforcing member is thinner than the reinforcing metal plate of the first reinforcing member.

(iv) The reinforcing metal plate of the first reinforcing member is thicker than the conductor.

(v) An end portion of the reinforcing metal plate of the first reinforcing member comprises a tapered shape or an arc shape.

(2) According to another embodiment of the invention, a connection structure between a flat cable and a printed wiring board comprises:

a flat cable; and a printed wiring board, wherein the flat cable comprises:

a plurality of conductors arranged in parallel;

an insulating member covering the plurality of conductors;

a first reinforcing member on a surface of an end portion of the insulating member so as to fix both end portions of the plurality of conductors to the printed wiring board; and a second reinforcing member on a opposite side of the first reinforcing member across the conductor and the insulating member, the second reinforcing member being fixed to the printed wiring board, wherein the first reinforcing member comprises a reinforcing metal plate comprising an end portion bent toward the second reinforcing member, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member, wherein the second reinforcing member has a rigidity greater than that of the covering member of the first reinforcing member, and wherein the plurality of conductors are connected at both end portions thereof to corresponding electrodes of the printed wiring board.

In the above embodiment (2) of the invention, the following modifications and changes can be made.

(vi) The second reinforcing member comprises a reinforcing metal plate, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member.

(vii) The second reinforcing member comprises a covering member thicker than the covering member of the first reinforcing member, and an adhesive interposed between the covering member of the second reinforcing member and the insulating member to bond therebetween.

(viii) The reinforcing metal plate of the second reinforcing member is thinner than the reinforcing metal plate of the first reinforcing member.

(ix) The reinforcing metal plate of the first reinforcing member is thicker than the conductor.

(x) An end portion of the reinforcing metal plate of the first reinforcing member comprises a tapered shape or an arc shape.

Points of the Invention

According to one embodiment of the invention, a flat cable is constructed such that a first reinforcing member is fixed to a printed wiring board having a rigidity higher than a flat cable body via an exposed metal plate portion of a reinforcing metal plate, a second reinforcing member is fixed both to an insulation film of the flat cable body and the printed wiring board. This configuration allows deformation in the vicinity of a conductor-solder connecting portion to be restricted or prevented by the first reinforcing member and the second reinforcing member as well as the printed wiring board.

BRIEF DESCRIPTION OF THE DRAWINGS

The present invention will be explained below in more detail in conjunction with appended drawings, wherein.

DETAILED DESCRIPTION OF THE PREFERRED EMBODIMENTS

Summary of the Embodiments

Figure 1:
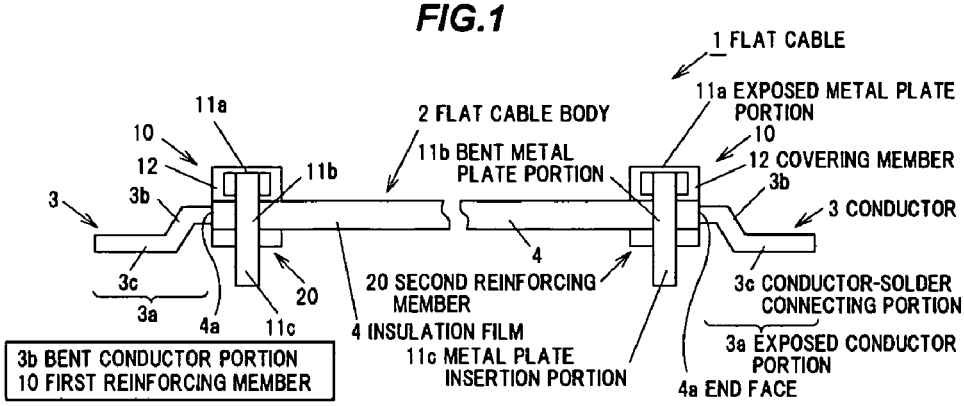
FIG. 1 is a schematic side view showing a typical flat cable in a first embodiment of the present invention.
Figure 2:
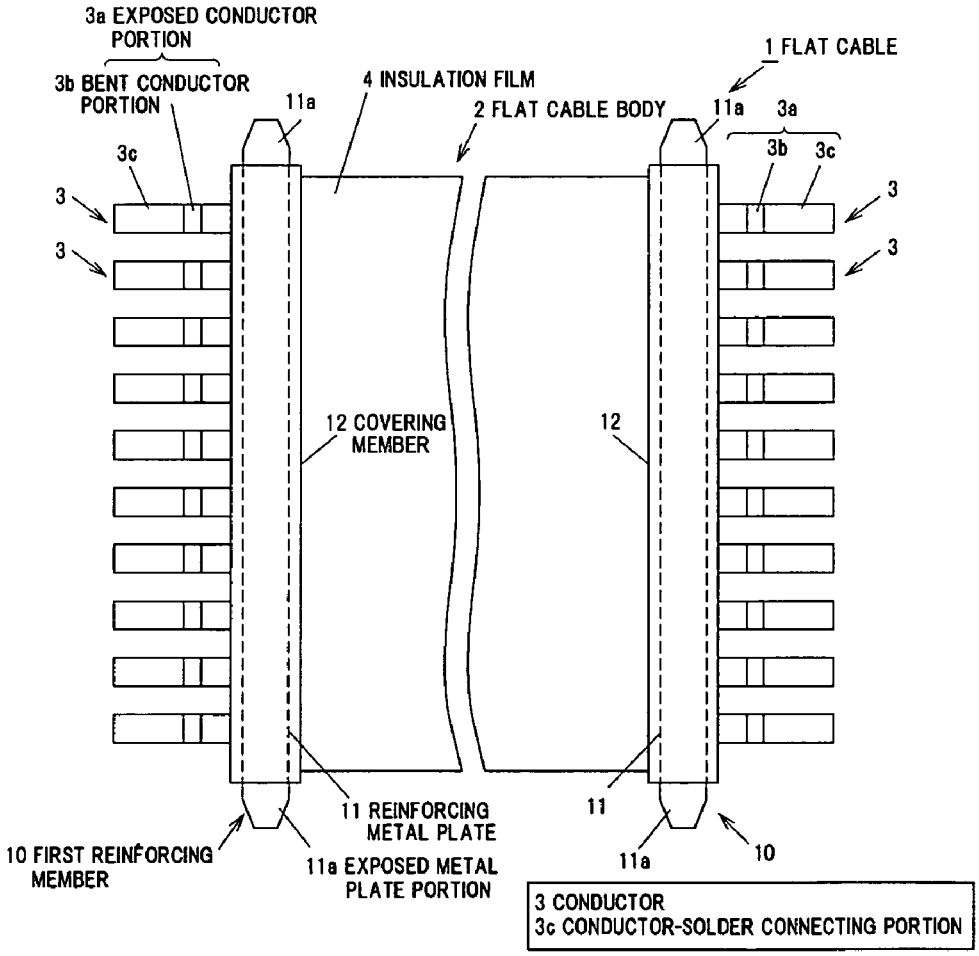
FIG. 2 is a plan view showing the flat cable shown in FIG. 1.
Figure 3:
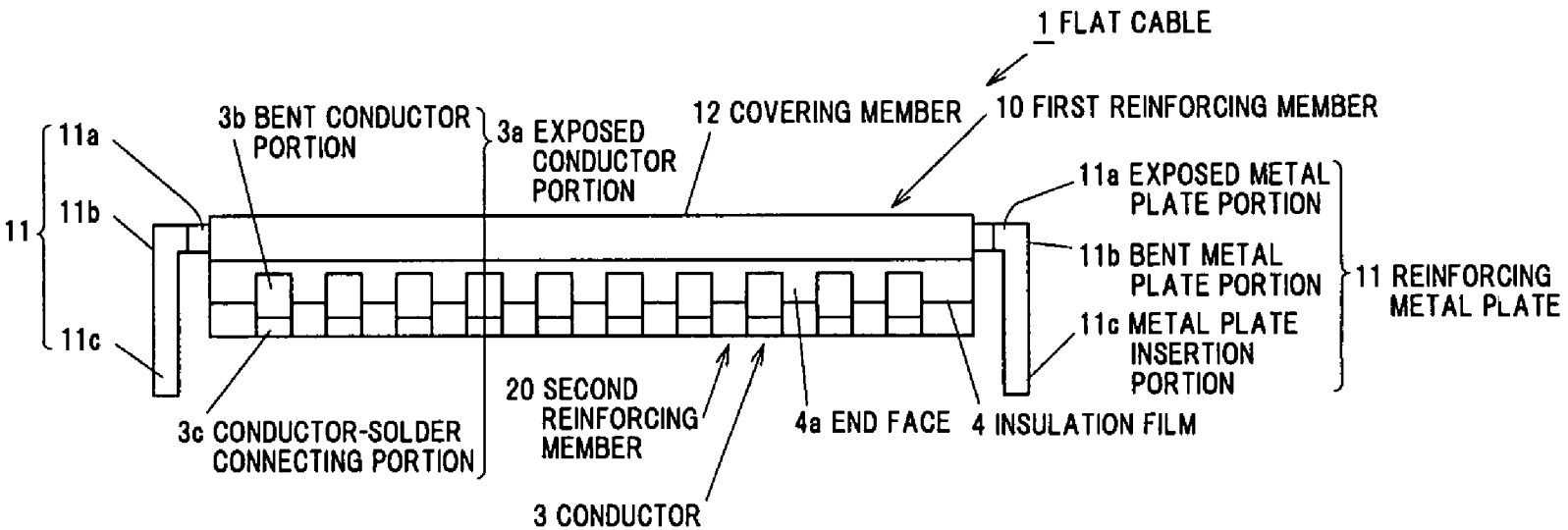
FIG. 3 is a front view showing the flat cable shown in FIG. 1.

A flat cable in embodiments of the invention is provided with plural conductors arranged in parallel, an insulating member for covering the plural conductors, a first reinforcing member provided on a surface of an end portion of the insulating member and a second reinforcing member provided at a position opposite to the first reinforcing member across the conductor and the insulating member, wherein the first reinforcing member comprises a reinforcing metal plate having an end portion bent toward the second reinforcing member, a covering member for covering at least a portion of the periphery of the reinforcing metal plate and an adhesive interposed between the reinforcing metal plate and the covering member and between the covering member and the insulating member to bond the reinforcing metal plate to the covering member and the covering member to the insulating member, and the second reinforcing member has rigidity greater than that of the covering member of the first reinforcing member.

Meanwhile, a connection structure between a flat cable and a printed wiring board in the embodiments of the invention is provided with the a flat cable and a printed wiring board, wherein the flat cable comprises plural conductors arranged in parallel, an insulating member for covering a middle portion of the plural conductors excluding both end portions, a first reinforcing member provided on a surface of an end portion of the insulating member to fix the both end portion of the plural conductors to the printed wiring board and a second reinforcing member provided at a position opposite to the first reinforcing member across the conductor and the insulating member for fixation to the printed wiring board, the first reinforcing member comprises a reinforcing metal plate having an end portion bent toward the second reinforcing member, a covering member for covering at least a portion of the periphery of the reinforcing metal plate and an adhesive interposed between the reinforcing metal plate and the covering member and between the covering member and the insulating member to bond the reinforcing metal plate to the covering member and the covering member to the insulating member, the second reinforcing member has rigidity greater than that of the covering member of the first reinforcing member, and the plural conductors are connected at both end portions thereof to corresponding electrodes of the printed wiring board.

In order to increase rigidity of the second reinforcing member more than the covering member of the first reinforcing member, the periphery of the reinforcing metal plate may be coated with the covering member or the second reinforcing member may be formed of a covering member thicker than the covering member provided on the first reinforcing member, however, it is not limited thereto.

Preferred embodiments of the invention will be specifically described below in conjunction with the appended drawings.

First Embodiment

Overall Structure of Flat Cable

The overall structure of a flat cable is illustrated in FIGS. 1 to 4 and the entire flat cable is indicated by the reference numeral 1. The flat cable 1 is provided with a flat cable body 2, and a pair of first reinforcing members 10, 10 for reinforcing fixation of longitudinal end portions of the flat cable body 2 to a printed wiring board 30. The first reinforcing members 10, 10 are respectively provided with second reinforcing members 20, 20 for reinforcing the fixation of the longitudinal end portions of the flat cable body 2 to the printed wiring board 30. The first reinforcing member 10 and the second reinforcing member 20 are respectively arranged on front and back surfaces of the flat cable body 2 so as to face each other. In other words, the second reinforcing member 20 is provided substantially within a projection plane of the first reinforcing member 10, and the first reinforcing member 10 and the second reinforcing member 20 are fixed to the front and back surfaces of the flat cable body 2 using an adhesive or a bonding agent, etc. Although the overall structure of the flat cable in which the first reinforcing member 10 and the second reinforcing member 20 are provided at the both end portions of the flat cable body 2 is explained, the first reinforcing member 10 and the second reinforcing member 20 may be provided at only one end portion of the flat cable body 2.

Structure of Flat Cable Body

As shown in FIGS. 1 to 4 and 8C, the flat cable body 2 has plural signal conductors 3, an insulation film 4 as an example of an insulating member for covering a middle portion of the conductor 3 excluding the end portion, and an adhesive 5 for adhesively fixing the conductor 3 to the insulation film 4.

The conductor 3 is formed of, e.g., a copper alloy material such as oxygen-free copper or tough pitch copper. Plating may be applied to the surface of the copper alloy material using at least one or more metal materials selected from the group consisting of tin (Sn), nickel (Ni) and silver (Ag), etc. It is possible to form a single or plural metal layers on the surface of the copper alloy material by the plating processing. The insulation film 4 is formed of a film-like polyimide resin, etc., having insulation properties. The adhesive 5 is formed of a silicone resin, an acrylic resin or an epoxy resin, etc.

The conductor 3 is formed in an elongated plate-like shape and the conductors 3 are arranged parallel in a width direction of the flat cable body 2, as shown in FIGS. 1 to 4. A signal conductor group is composed of the plural conductors 3. Both longitudinal end portions of the conductor 3 are exposed from the insulation film 4 at an edge face 4*a*, thereby forming a exposed conductor portion 3*a*. A conductor bent portion 3*b* having an S-shape or a gull-wing shape is formed in a middle portion of the exposed conductor portion 3*a*. The tip portion of the exposed conductor portion 3*a* is a conductor-solder connecting portion 3*c* to be connected to an electrode as an external conductor of the printed wiring board 30. If the exposed conductor portion 3*a* is extended more than necessary, short circuit may occur due to a contact of the exposed conductor portion 3*a* with a housing of a device on which a wiring component, etc., are mounted. Therefore, it is preferable that the exposed conductor portion 3*a* extends as less as possible.

Overall Structure of Reinforcing Member

The most important configuration in the first embodiment is a pair of the first reinforcing member 10 and the second reinforcing member 20 which are members for reinforcing end portions of a flat cable. As shown in the illustrated example, the first reinforcing member 10 is fixed on a surface of the flat cable body 2 at an end portion of the insulation film 4 and the f second reinforcing member 20 is fixed on an opposite surface of the end portion. The first reinforcing member 10 and the second reinforcing member 20 have substantially the same shape and structure.

As shown in FIGS. 1 to 4, the first reinforcing member 10 and the second reinforcing member 20 are members for restricting deformation by reinforcing a portion of the conductor 3 in the vicinity of the conductor-solder connecting portion 3*c*, and are provided in a region including the edge face 4*a* of the insulation film 4 so as to cover a portion of the plural conductors 3 in a direction different from a longitudinal direction of the conductor 3. The first reinforcing member 10 is provided on an upper surface of the flat cable body 2, i.e., on a surface not facing the printed wiring board 30 (hereinafter also referred to as "a non-facing surface"). Meanwhile, the second reinforcing member 20 is provided on a lower surface of the flat cable body 2, i.e., on a surface facing the printed wiring board 30 (hereinafter also referred to as "a facing surface").

Figure 4:
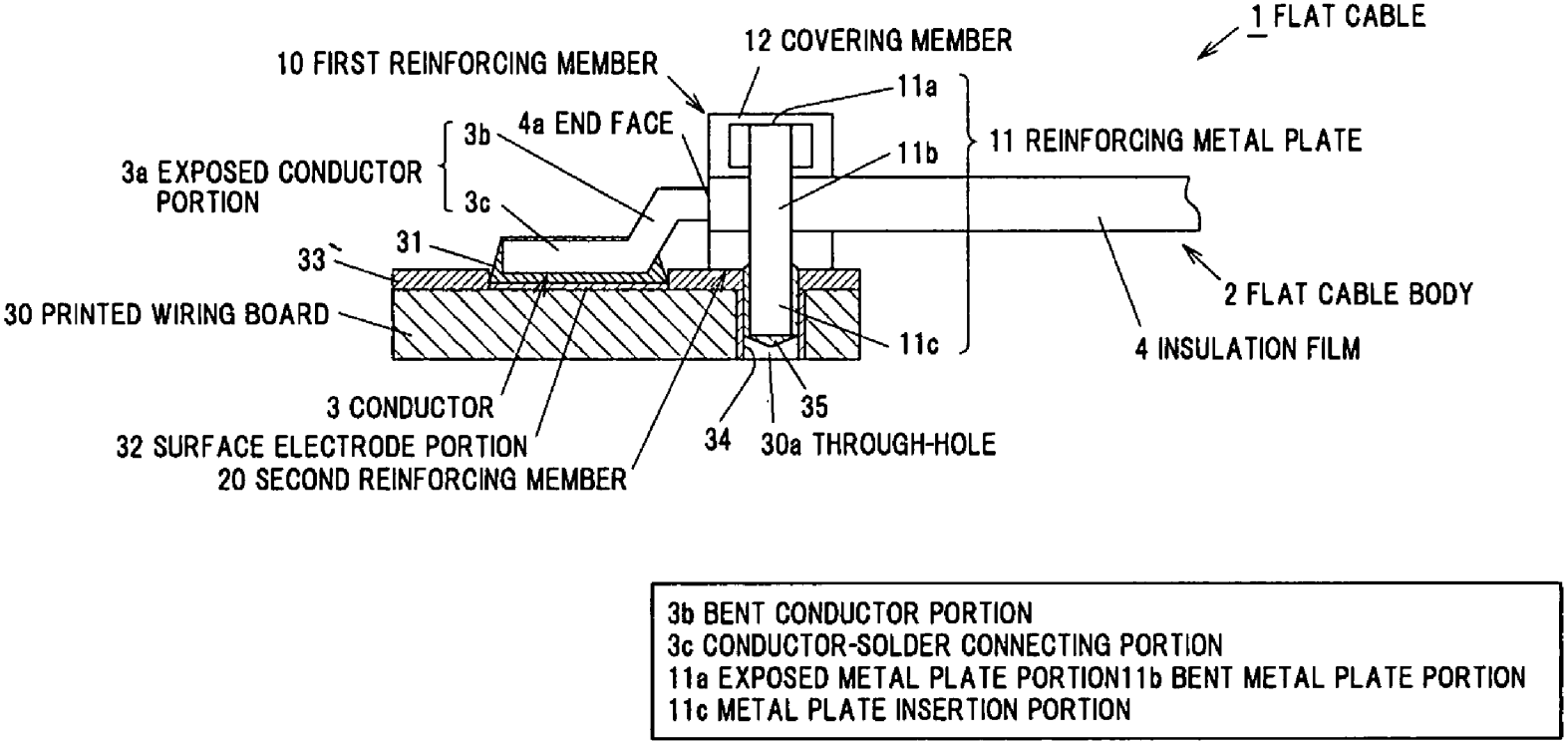
FIG. 4 is a schematic partial cross sectional view showing a state that the flat cable of FIG. 1 is attached to a printed wiring board.

In the illustrated example, the first reinforcing member 10 and the second reinforcing member 20 have an elongated rectangular shape extending in an array direction of the parallel arranged conductors 3. The first reinforcing member 10 and the second reinforcing member 20 are arranged to cover a portion of the conductor group along a width direction of the conductor 3 so as to traverse across the conductor group so that centers of the first reinforcing member 10 and the second reinforcing member 20 are located at a predetermined distance from the edge face 4*a* of the insulation film 4. The first reinforcing member 10 and the second reinforcing member 20 are arrange so that widthwise end portions thereof are flush with the edge face 4*a* of the insulation film 4 as shown in FIGS. 4 and 8C. Alternatively, the first reinforcing member 10 and the second reinforcing member 20 may extend from the edge face 4*a* of the insulation film 4 toward the exposed conductor portion 3*a*.

Structure of First Reinforcing Member

As shown in FIGS. 1 to 4 and 8C, the first reinforcing member 10 has an elongated rectangular reinforcing metal plate 11, a covering member 12 as an insulating covering layer for covering the reinforcing metal plate 11 and an adhesive 13 as an adhesive layer for bonding the reinforcing metal plate 11 to the covering member 12. The reinforcing metal plate 11 is used for forming the center region of the first reinforcing member 10, thereby increasing rigidity of the first reinforcing member 10. The rigidity here means being less likely to deform against an external force applied to the flat cable which causes flexure, tension or twist, etc. Resonant vibration of the flat cable itself is an example of the external force applied to the flat cable. The conductor 3, the insulation film 4 and the adhesive 5 composing the flat cable body 2, and the reinforcing metal plate 11, the covering member 12 and the adhesive 13 composing the first reinforcing member 10 are respectively formed of the same materials or materials having similar characteristics, and are formed as plural layers laminated in substantially the same manner.

It is desirable that the reinforcing metal plate 11 be formed of a material having strength higher than that of the conductor 3, and for example, phosphor bronze or iron (Fe)-nickel (Ni) alloy, etc., is used. Plating may be applied to the surface of the reinforcing metal plate 11 in the same manner as the conductor 3, and metals such as tin (Sn), nickel (Ni) and silver (Ag) can be used so that a single or plural materials are laminated. Alternatively, a reinforcing plate which is formed of a resin material other than a metal material may be used as the reinforcing metal plate 11, or the reinforcing metal plate 11 may be formed of the same material as the conductor 3. In this case, it is preferable to set the thickness of the reinforcing metal plate 11 to be thicker than the conductor 3, e.g., to set to 0.75 to 1.0 mm, in order to increase rigidity of the reinforcing metal plate 11.

As a material of the covering member 12, a film-like polyimide resin, polyamide resin, fluorine resin (PTFE or PFA, etc.), polyaminobismaleimide resin or polyethylene terephthalate resin, etc., having the same insulation properties as the insulation film 4 of the flat cable body 2 is used.

Meanwhile, as shown in FIG. 8C, the adhesive 13 is provided on upper and lower sides of the covering member 12 which is located on a side facing the flat cable body 2, and the first reinforcing member 10 is fixed to the surface of the insulation film 4 of the flat cable body 2 by the lower adhesive 13. The adhesive 13 may be formed of the same material as the adhesive 5 of the flat cable body 2, and for example, an epoxy resin, a silicone resin or an acrylic resin, etc., can be applied as an adhesive and cured to form an adhesive member. The adhesive 13 is preferably formed to be thin unless a function of bonding the first reinforcing member 10 to the flat cable body 2 is impaired. The adhesive 13 may be provided to a portion of the first reinforcing member 10 but is preferably provided over the entire first reinforcing member 10 from the viewpoint of preventing the interface from separating.

As shown in FIGS. 1 to 4, the reinforcing metal plate 11 of the first reinforcing member 10 is partially exposed from the covering member 12 at both longitudinal end portions (end portions in an array direction of the parallel arranged conductors 3) of the reinforcing member to form a exposed metal plate portion 11*a*. The exposed metal plate portion 11*a* is extended by continuously forming a taper-shaped portion and a linear portion. A metal plate bent portion 11*b* bent in a direction of the lower surface of the flat cable body 2 (a surface facing the printed wiring board) is formed between the taper-shaped portion and the linear portion. A free end of the metal plate bent portion 11*b* is a metal plate insertion portion 11*c*. The metal plate insertion portion 11*c* is inserted into a through-hole electrode of the printed wiring board 30 which is provided to correspond to each of the plural conductors 3. The tip portion of the metal plate insertion portion 11*c* serves as a solder-connecting portion which is connected to the through-hole electrode.

In the illustrated example, the tip portion of the metal plate insertion portion 11*c* has a straight shape, however, it is not limited thereto. It is possible to easily insert the exposed metal plate portion 11*a* into the through-hole electrode of the printed wiring board 30 by shaping the tip portion of the metal plate insertion portion 11*c* into various forms, e.g., a tapered shape or an arc shape.

Structure of Second Reinforcing Member

The second reinforcing member 20 also has a an elongated rectangular reinforcing metal plate 21, a covering member 22 for covering the reinforcing metal plate 21 and an adhesive 23 for bonding the reinforcing metal plate 21 to the covering member 22, as shown in FIG. 8C. Thus, the second reinforcing member 20 has rigidity greater than that of the covering member 12 of the first reinforcing member 10. The reinforcing metal plate 21 is used for forming the center region of the second reinforcing member 20, thereby increasing rigidity of the second reinforcing member 20. The reinforcing metal plate 21, the covering member 22 and the adhesive 23 composing the second reinforcing member 20 and the components of the first reinforcing member 10 are respectively formed of the same materials or materials having similar characteristics, and are formed as plural layers laminated in substantially the same manner.

The adhesive 23 is provided on upper and lower sides of the covering member 22 which is located on a side facing the flat cable body 2, and the second reinforcing member 20 is fixed to the surface of the insulation film 4 of the flat cable body 2 by the upper adhesive 23. The adhesive 23 is preferably formed to be thin unless a function of bonding the second reinforcing member 20 to the flat cable body 2 is impaired. The adhesive 23 may be provided to either a portion of the second reinforcing member 20 or over the entire second reinforcing member 20.

Although the second reinforcing member 20 is bonded and fixed to the flat cable body 2 as well as the printed wiring board 30 by the adhesive 23, the adhesive 23 is softened at a high temperature, which may decrease a deformation restricting effect. The adhesive 23 is preferably formed of a material having a high glass-transition temperature. Due to the restricting action of the first reinforcing member 10, the deformation amount of the flat cable body 2 in the vicinity of the conductor-solder connecting portion 3*c* does not significantly increase even when the adhesive 23 of the second reinforcing member 20 is softened under high temperature environment.

It is preferable that the second reinforcing member 20 be configured to have properties less likely to deform and has an elastic modulus higher than the first reinforcing member 10, considering the function of the second reinforcing member 20. The reinforcing metal plate 21 of the second reinforcing member 20 generally has an elastic modulus higher than the adhesive 23. Therefore, for the reinforcing metal plate 21, a reinforcing plate thinner than the reinforcing metal plate 11 of the first reinforcing member 10, e.g., 0.05 to 0.1 mm, is used as a fixing member as shown in FIG. 8C, thereby suppressing a decrease in the elastic modulus of the entire second reinforcing member 20.

Connection Structure Between Flat Cable and Printed Wiring Board

Figure 5:
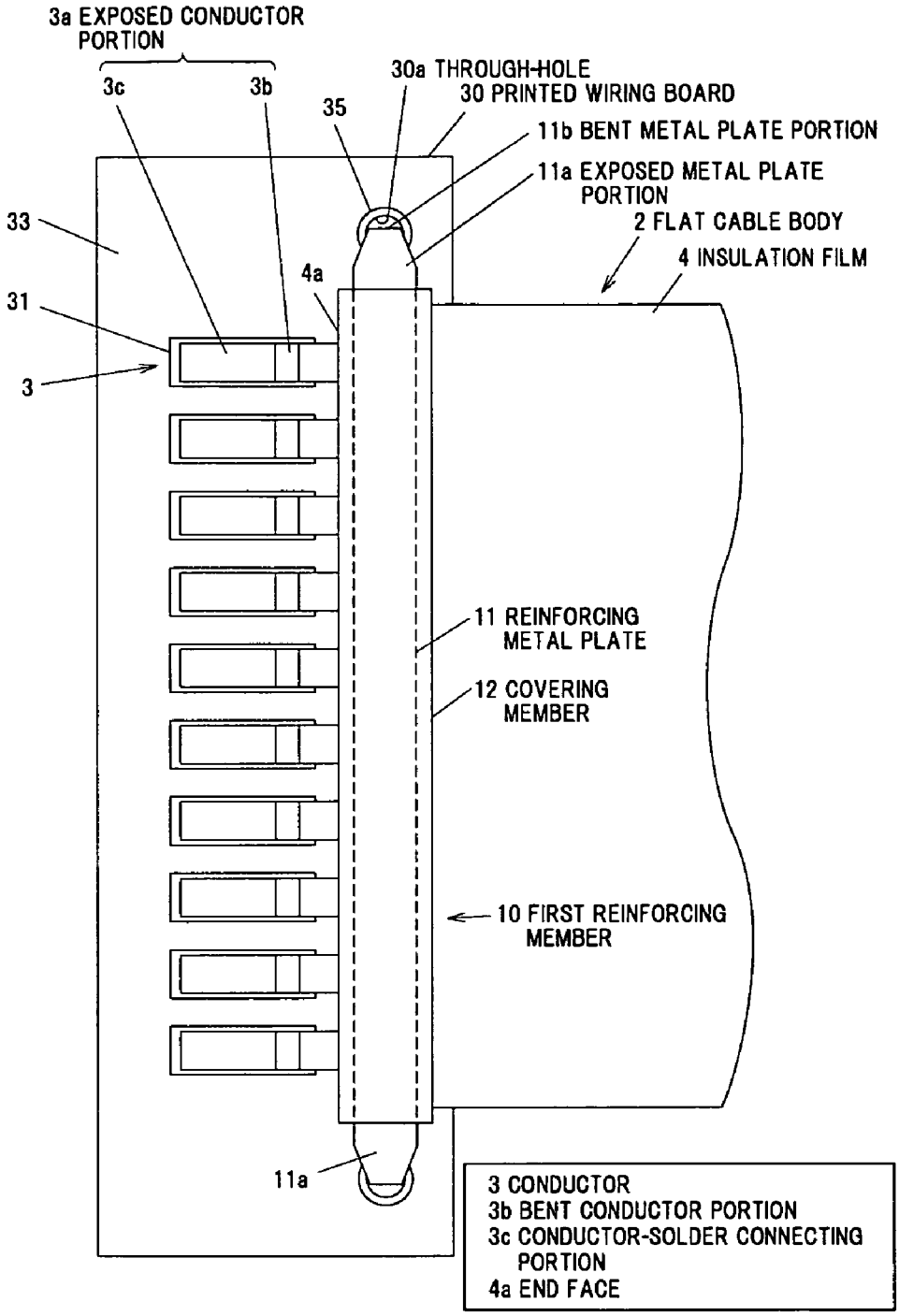
FIG. 5 is a schematic plan view showing a state that the flat cable of FIG. 1 is attached.

Referring to FIGS. 4 and 5, a state that the flat cable 1 is attached to the printed wiring board 30 is illustrated. Although FIGS. 4 and 5 show an example in which one end portion of the flat cable 1 is attached to the printed wiring board 30, another end portion of the flat cable 1 is also attached to the printed wiring board 30 in the same manner.

A surface electrode section 32 is exposed on the surface of the printed wiring board 30 from a solder resist 33 having electrical insulation, as shown in FIGS. 4 and 5. The conductor-solder connecting portion 3*c* of the conductor 3 is joined to the corresponding surface electrode section 32 by a jointing material 31 such as solder material or conductive adhesive so as to be electrically conductive therewith.

As shown in FIGS. 4 and 5, the metal plate insertion portion 11*c* of the exposed metal plate portion 11*a* of the first reinforcing member 10 is inserted into a through-hole 30*a* formed on the printed wiring board 30 and is joined by a jointing material 35 such as solder material to a through-hole electrode 34 formed on the inner surface of the through-hole 30*a*.

A solder material such as Sn-3Ag-0.5Cu (mass %) having a melting temperature of about 218° C. or Sn-3.5Ag (mass %) having a melting temperature of about 221° C. is used as the jointing material 31 which connects the conductor-solder connecting portion 3*c* of the conductor 3 to the surface electrode section 32 of the printed wiring board 30. The same solder materials as the jointing material 31 can be used for the jointing material 35 which connects the metal plate insertion portion 11*c* of the first reinforcing member 10 to the through-hole electrode 34 of the printed wiring board 30.

Figure 6:
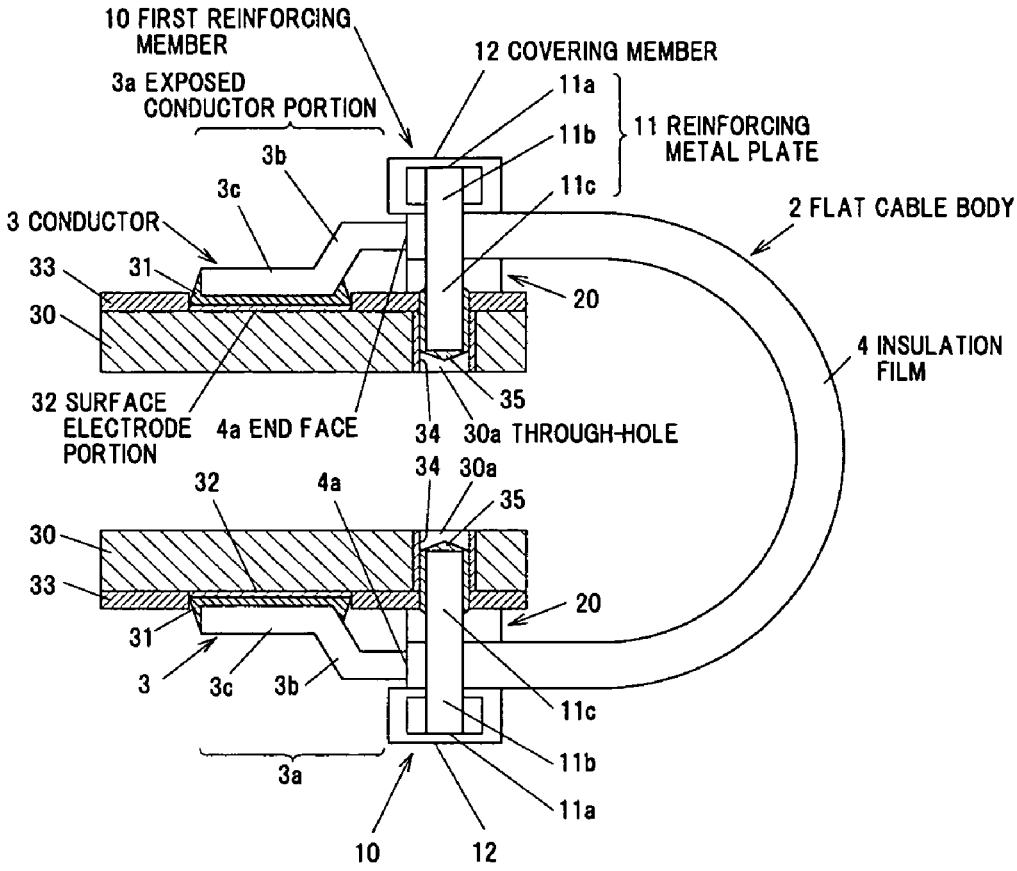
FIG. 6 is a schematic cross sectional view showing a state that the flat cable of FIG. 1 is attached so as to connect two printed wiring boards.

The flat cable 1 attached to the printed wiring board 30 via the first reinforcing member 10 and the second reinforcing member 20 configured as described above is attached to connect a pair of printed wiring boards 30, 30 in a state that a middle portion of the flat cable 1 is curved into a U-shape, as shown in FIG. 6.

As shown in FIG. 6, the printed wiring board 30 is formed thicker than the flat cable body 2 or the first reinforcing member 10 (e.g., about not less than 1.0 mm and not more than 1.6 mm) to have high rigidity. Thus, when mechanical vibration is applied to a device mounting the printed wiring board attached component in which two stacked printed wiring boards 30, 30 are connected by the flat cable 1, large vibratile deformation may be generated in the flat cable 1 itself connecting two printed wiring boards 30, 30 due to resonance phenomenon.

Particularly, when vibratile deformation in a plate thickness direction of the printed wiring board 30 is generated in the flat cable 1, the vibratile deformation acts intensively on a portion in the vicinity of the conductor-solder connecting portion 3*c* as a fixed end of the conductor 3. This generates high stress in the upper end portion of the jointing material 31 which joins the conductor-solder connecting portion 3*c* to the surface electrode section 32 of the printed wiring board 30 or in the exposed conductor portion 3*a* of the conductor 3 in the vicinity of the edge face 4*a* of the insulation film 4.

In the connection structure of the flat cable 1 in the illustrated example, rigidity of the first reinforcing member 10 which is arranged on a portion of the flat cable body 2 in the vicinity of the edge face 4*a* of the insulation film 4 is increased by forming the reinforcing metal plate 11 using a material having strength higher than that of the conductor 3 or a material thicker than the conductor 3. Particularly, the reinforcing metal plate 11 of the first reinforcing member 10 arranged on the printed wiring board non-facing side (upper side) of the flat cable body 2 is formed of a material having high strength and high rigidity to suppress the vibratile deformation in the vicinity of the conductor-solder connecting portion 3*c* and to disperse concentration of high stress.

In addition to this configuration, it is configured that the metal plate insertion portion 11*c* as the tip portion of the exposed metal plate portion 11*a* of the reinforcing metal plate 11 of the first reinforcing member 10 is inserted into the through-hole 30*a* of the printed wiring board 30 and is joined to the through-hole electrode 34 by the jointing material 31 at the solder-connecting portion of the metal plate insertion portion 11*c*. By configuring such that the flat cable body 2 is fixed to the printed wiring board 30 having rigidity higher than the flat cable body 2 via the first reinforcing member 10, a portion of the flat cable body 2 in the vicinity of the conductor-solder connecting portion 3*c* is firmly fixed to the printed wiring board 30. Since the vibratile deformation in the vicinity of the conductor-solder connecting portion 3*c* is restricted by the printed wiring board 30, the deformation amount in the vicinity of the conductor-solder connecting portion 3*c* is significantly reduced.

On the other hand, the second reinforcing member 20 having relatively high rigidity is provided substantially within a projection plane of the first reinforcing member 10 so as to interpose in a gap between the flat cable body 2 and the printed wiring board 30. By this structure, the flat cable body 2 is strongly restricted by the printed wiring board 30 and movement of the flat cable body 2 to deform in a facing direction of the pair of facing printed wiring boards 30, 30 is physically suppressed. The deformation amount in the vicinity of the conductor-solder connecting portion 3*c* is further reduced.

Effects of the Reinforcing Member and the Connection Structure Between the Flat Cable and the Printed Wiring Board In addition to the effect described above, the following effect is obtained by the reinforcing member and the connection structure between a flat cable and a printed wiring board in the first embodiment which are configured as described above.

The first reinforcing member 10 is fixed to the printed wiring board 30 having rigidity higher than the flat cable body 2 via the exposed metal plate portion 11*a* of the reinforcing metal plate 11. On the other hand, the second reinforcing member 20 is fixed to both the insulation film 4 of the flat cable body 2 and the printed wiring board 30. Such a configuration allows deformation in the vicinity of the conductor-solder connecting portion 3*c* to be restricted by the first reinforcing member 10 and the second reinforcing member 20 as well as by the printed wiring board 30. By forming the first reinforcing member 10 and the second reinforcing member 20 and fixing to the printed wiring board 30, the deformation amount in the vicinity of the conductor-solder connecting portion 3*c* caused by vibration of the printed wiring board 30 itself in a plate thickness direction can be greatly reduced even if mechanical load such as vibration or impact applied to portions having significantly different rigidities, such as a conductor portion of the flat cable body 2 in the vicinity of the edge face 4*a* of the insulation film 4 and a conductor portion of at the upper edge of the solder fillet, is also applied to a device mounting the printed wiring board 30 to which the flat cable body 2 is attached. At the same time, it is possible to greatly reduce stress generated in the conductor 3 of the flat cable body 2.

In other words, the deformation generated in the vicinity of the conductor-solder connecting portion 3*c* of the flat cable body 2 connecting a pair of printed wiring boards 30, 30 as shown in FIG. 6 due to resonant vibration of the flat cable body 2 can be suppressed by restriction of the first reinforcing member 10 and the second reinforcing member 20. It is possible to suppress concentration of high stress at the upper end portion of the conductor-solder connecting portion 3*c* of the conductor 3 or at the exposed conductor portion 3*a* in the vicinity of the edge face 4*a* of the insulation film 4.

The second reinforcing member 20 of the flat cable 1 is arranged between the facing surfaces of the flat cable body 2 and the printed wiring board 30. Therefore, the flat conductor-solder connecting portion 3*c* formed in accordance with formation of the conductor bent portion 3*b* formed by bending the exposed conductor portion 3*a* into an S-shape or a gull-wing shape is connected to the corresponding surface electrode section 32 of the printed wiring board 30, and it is thus possible to press the bottom (a printed wiring board facing surface) of the conductor-solder connecting portion 3*c* against the surface electrode section 32 of the printed wiring board 30. As a result, it is possible to prevent a gap between the conductor 3 and the printed wiring board 30 from unnecessarily widening. An effect of suppressing generation and remaining of voids in solder is obtained by controlling the gap when a solder material is used for connection. Since suppression of void allows the stress concentration due to the presence of void to be suppressed even when mechanical load such as vibration acts on the conductor-solder connecting portion 3*c*, it is possible to prevent damage to the conductor-solder connecting portion 3*c*.

When the flat cable 1 is attached to the printed wiring board 30, an excessive pressing force may be applied from above the flat cable body 2. When the conductor bent portion 3*b* is provided to the exposed conductor portion 3*a*, the exposed conductor portion 3*a* may be deformed by pressing load and high stress may be generated in the conductor 3 at the upper end portion of the conductor-solder connecting portion 3*c* or in the exposed conductor portion 3*a* in the vicinity of the edge face 4*a* of the insulation film 4, leading to cause damage.

In the illustrated example, the second reinforcing member 20 filling the gap between the flat cable body 2 and the printed wiring board 30 in the vicinity of the edge face 4*a* of the insulation film 4 serves as a buffer material receiving a force which presses the flat cable body 2 toward the printed wiring board 30. As a result, it is possible to suppress excessive load acting on the exposed conductor portion 3*a*. Deformation in a direction to narrow the gap between the flat cable body 2 and the printed wiring board 30 is easily suppressed by fixing the second reinforcing member 20 to boththe insulation film 4 and the printed wiring board 30.

Method of Manufacturing the Flat Cable

A method of manufacturing the flat cable 1 will be described below with reference to FIGS. 7 and 8A to 8F. It should be noted that FIGS. 7 to 8F illustrate only one end portion of the flat cable body 2.

Figure 7:
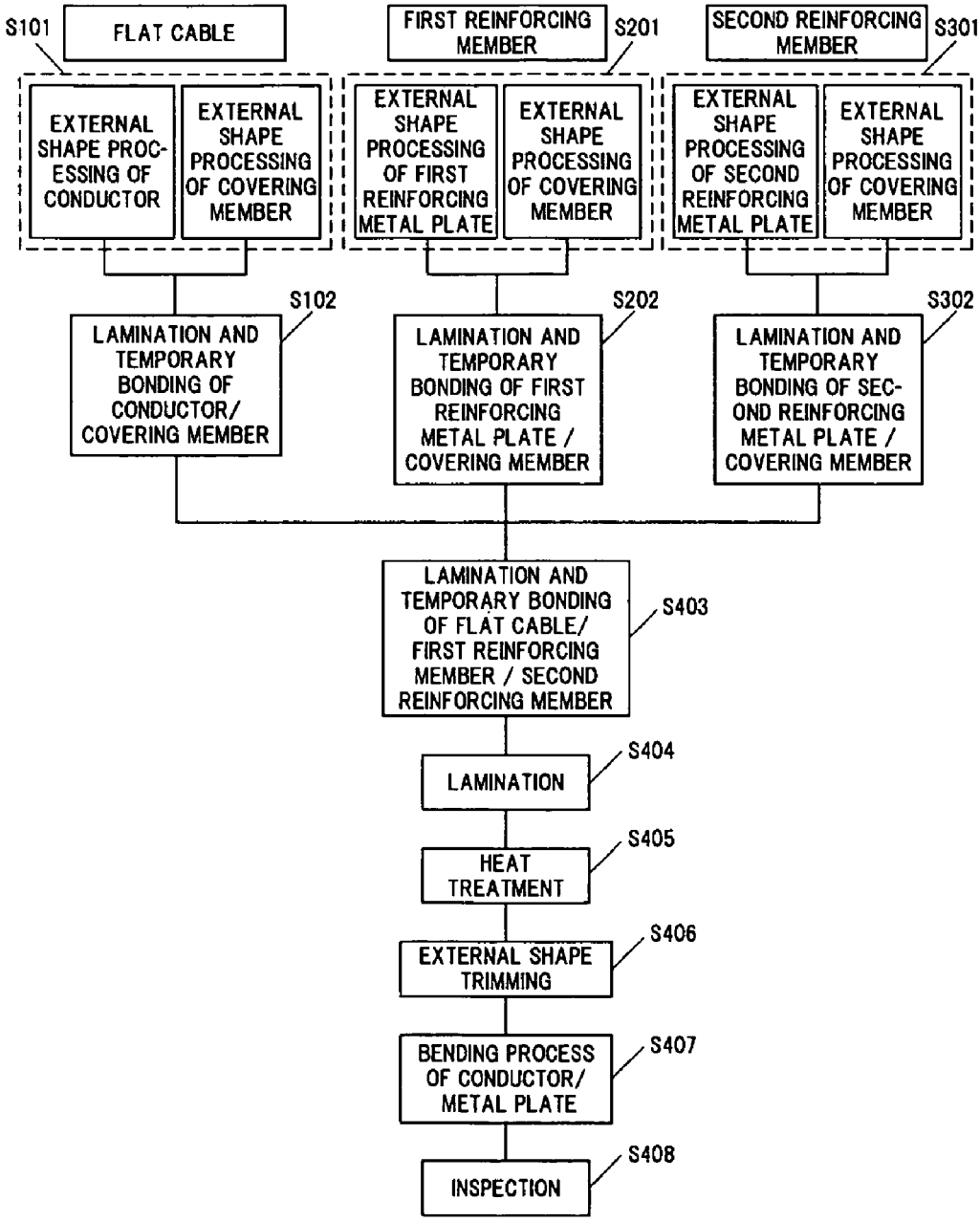
FIG. 7 is a flow chart for explaining a manufacturing process of the flat cable shown in FIG. 1.

For manufacturing the flat cable 1, firstly, the conductor 3, the insulation film 4 and the adhesive 5 composing the flat cable body 2, the reinforcing metal plate 11, the covering member 12 and the adhesive 13 composing the first reinforcing member 10, and the reinforcing metal plate 21, the covering member 22 and the adhesive 23 composing the second reinforcing member 20 are prepared (Steps S101, S201 and S301 shown in FIG. 7). The structural members are laminated and temporarily bonded (Steps S102, S202 and S302 shown in FIG. 7). An external shape processing is performed on the conductor 3 and the reinforcing metal plates 11 and 21 by stamping using a mold or by etching, etc. An external shape processing is performed on the insulation film 4 and the covering members 12 and 22 by punching using a mold.

Figure 8A:
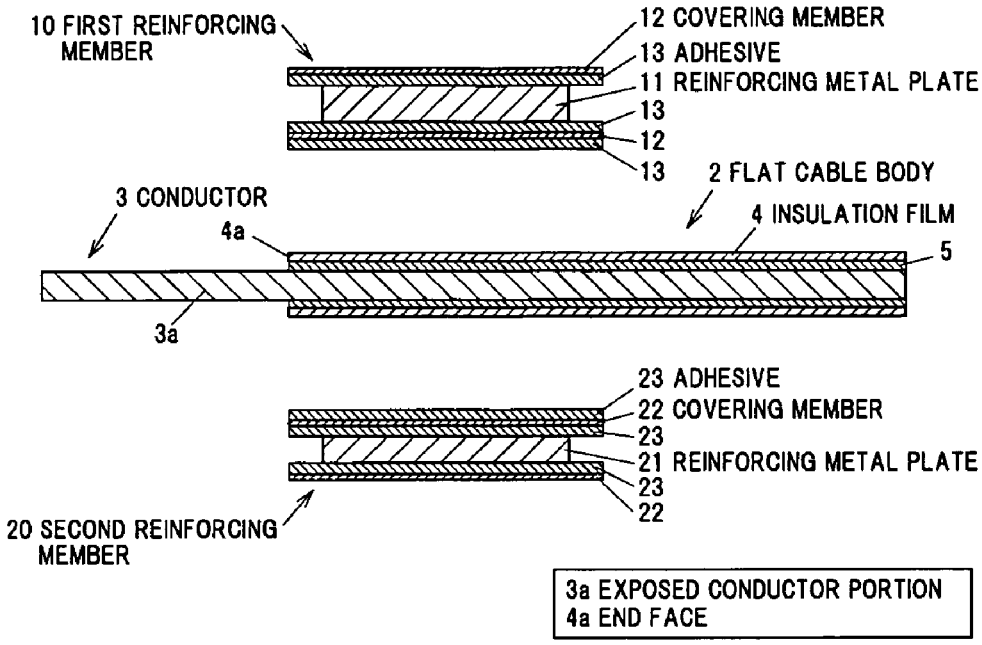
FIG. 8A is a schematic cross sectional view showing a process of manufacturing the flat cable of FIG. 1.

For the flat cable 1, as shown in FIG. 8A, the adhesive 5 is applied to the conductor 3 formed into a predetermined shape by the external shape processing as well as to the insulation film 4 formed into a predetermined shape by the external shape processing in the same manner so as to be shorter than the conductor 3, and the insulation film 4 is laminated on and temporarily bonded to upper and lower sides of the conductor 3 in the middle portion thereof excluding the both send portions via the adhesive 5.

For the first reinforcing member 10, as shown in FIG. 8A, the adhesive 13 is applied to the reinforcing metal plate 11 formed into a predetermined shape by the external shape processing as well as to the covering member 12 formed into a predetermined shape by the external shape processing in the same manner, and the covering member 12 is laminated on and temporarily bonded to upper and lower sides of the reinforcing metal plate 11 via the adhesive 13.

Meanwhile, also for the second reinforcing member 20, the covering member 22 is laminated on and temporarily bonded to upper and lower sides of the reinforcing metal plate 21 via the adhesive 23 in the same manner as the first reinforcing member 10. Thus, works of the steps S101, S102, S201, S202, S301 and S302 shown in FIG. 7 are completed. Then, it proceeds to the step S403 of FIG. 7.

Figure 8B:
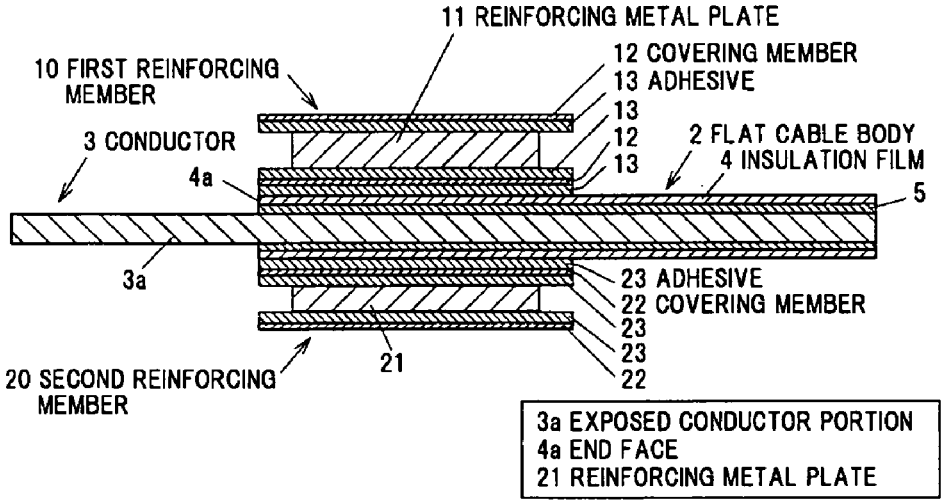
FIG. 8B is a cross sectional view showing a process following FIG. 8A.
Figure 8C:
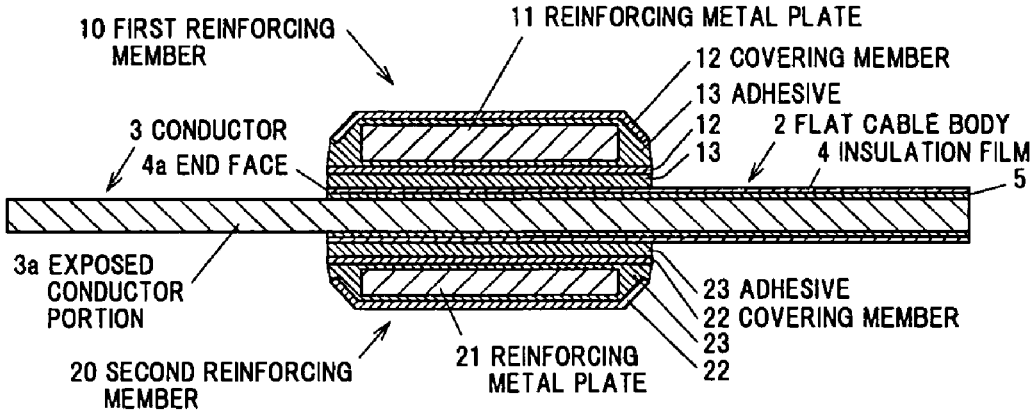
FIG. 8C is a cross sectional view showing a process following FIG. 8B.

In the step S403, as shown in FIG. 8B, the first reinforcing member 10 is placed on the upper surface of the flat cable body 2 and the second reinforcing member 20 on the lower surface of the flat cable body 2 so as to be flush with the edge face 4*a* of the insulation film 4 of the flat cable body 2, and are temporarily bonded by the adhesives 13 and 23. As a result, a laminated body composed of the flat cable body 2, the first reinforcing member 10 and the second reinforcing member 20 is obtained. Although FIG. 8B illustrates only one end portion of the flat cable body 2, the first reinforcing member 10 and the second reinforcing member 20 are temporarily bonded to another non-illustrated end portion of the flat cable body 2 in the same manner as the one end portion. Thus, work in the step S403 of FIG. 7 is completed. Then, it proceeds to the step S404 of FIG. 7.

Figure 8D:
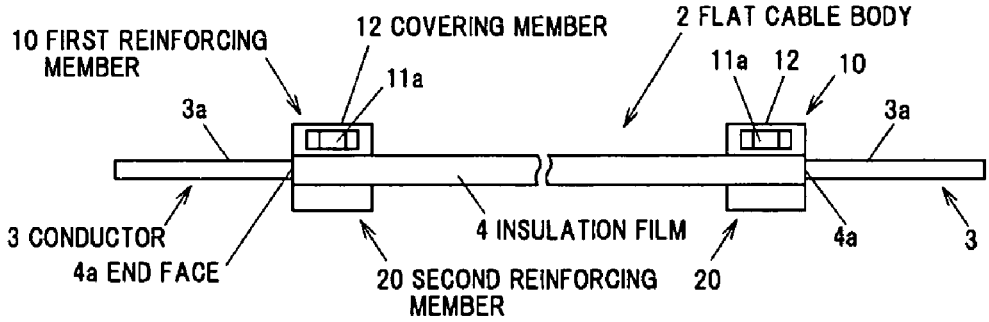
FIG. 8D is a side view showing a process following FIG. 8C.
Figure 8E:
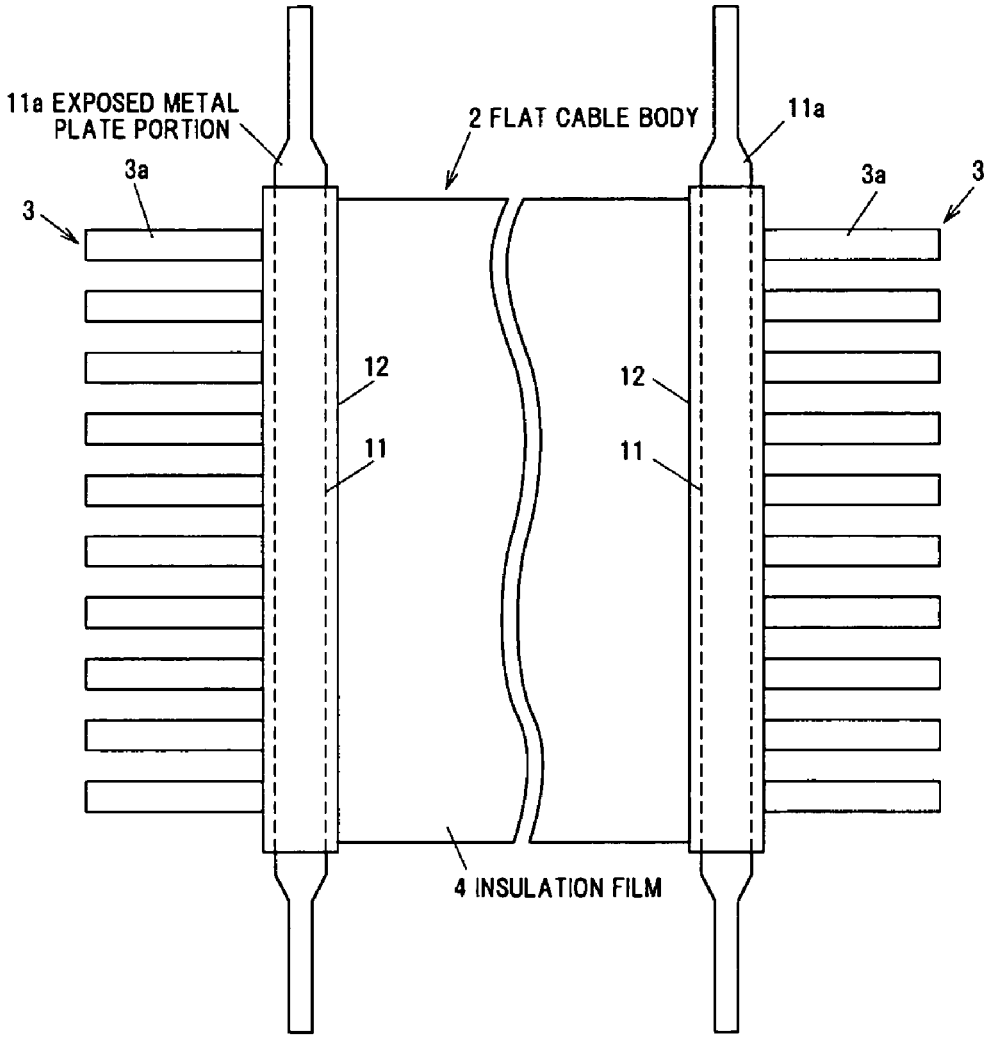
FIG. 8E is a plan view showing a process following FIG. 8D.
Figure 8F:
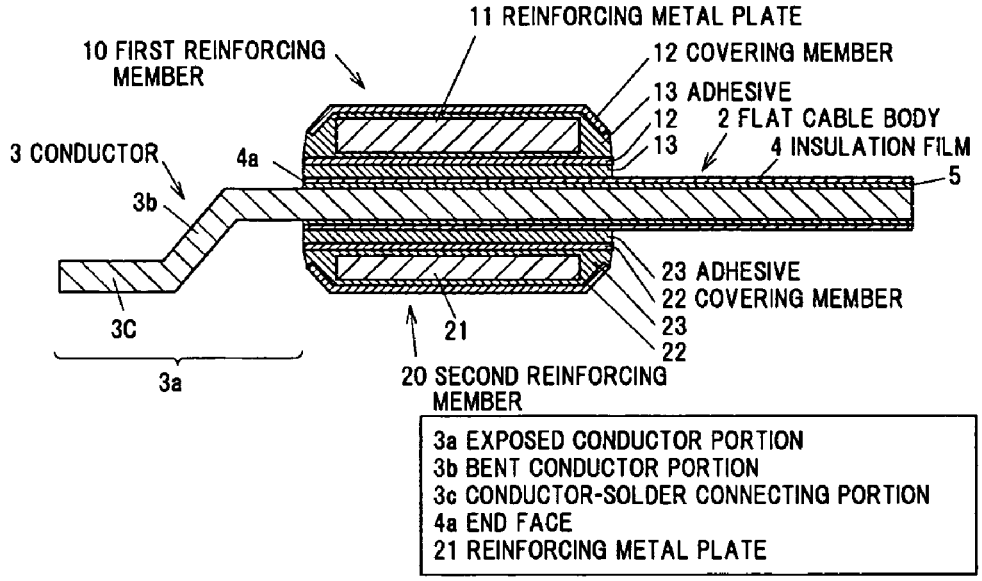
FIG. 8F is a cross sectional view showing a process following FIG. 8E.

In the step S404, pressure is applied in a vertical direction of the laminated body composed of the flat cable body 2, the first reinforcing member 10 and the second reinforcing member 20 by heat pressing, thereby laminating the upper and lower surfaces of the reinforcing metal plates 11 and 21 by the covering members 12, 22, the adhesives 13 and 23, as shown in FIG. 8C. The heat pressing may alternatively be performed in a vacuum. Next, in the step S405 of FIG. 7, the adhesives 5, 13 and 23 are cured by performing heat treatment on the structural members of the laminated body. In the next step S406 of FIG. 7, the external shape of the laminated body is shaped by punching and is trimmed into a predetermined shape as shown in FIGS. 8D and 8E. Then, it proceeds to the step S407 of FIG. 7.

In the step S407, as shown in FIG. 8F, the exposed conductor portion 3*a* exposed from the edge face 4*a* of the insulation film 4 of the flat cable body 2 is bent into a predetermined shape, thereby forming the conductor bent portion 3*b* and the conductor-solder connecting portion 3*c*. The reinforcing metal plate 11 of the first reinforcing member 10 is also bent into a predetermined shape, thereby forming the metal plate bent portion 11*b* and the metal plate insertion portion 11*c*. The bending process is performed by press working using a mold, etc. After completing the bending process, the flat cable body 2 is inspected in the step S408 shown in FIG. 7, and the flat cable 1 as a finished product is obtained.

Effects of the Method of Manufacturing the Flat Cable

The conductor 3, the insulation film 4 and the adhesive 5 composing the flat cable body 2, the reinforcing metal plate 11, the covering member 12 and the adhesive 13 composing the first reinforcing member 10, and the reinforcing metal plate 21, the covering member 22 and the adhesive 23 composing the second reinforcing member 20 are respectively formed of the same materials or materials having similar characteristics, and have substantially the same laminated structure. By employing such a configuration, it is possible to manufacture the first reinforcing member 10 and the second reinforcing member 20 in the same manufacturing process as the flat cable body 2.

Furthermore, the flat cable 1 shown in the illustrated example can be manufactured at a time by laminating a material for forming the flat cable body 2 and materials for forming the first reinforcing member 10 and the second reinforcing member 20 in a predetermined arrangement and then integrating by lamination treatment. As a result, the first reinforcing member 10 and the second reinforcing member 20 are firmly fixed to the flat cable body 2 via the covering members 12, 22, the adhesives 13 and 23.

Since the structural members of the first reinforcing member 10 and the second reinforcing member 20 are the same or similar to the structural members of the flat cable body 2, the flat cable 1 provided with the first reinforcing member 10 and the second reinforcing member 20 can be integrally manufactured by using a conventional manufacturing process of a flat cable. By integrating the flat cable body 2 with the first reinforcing member 10 and the second reinforcing member 20, the flat cable 1 provided with the first reinforcing member 10 and the second reinforcing member 20 can be attached to the printed wiring board 30 by one reflow step and it is possible to simplify the attachment step.

Method of Attaching the Flat Cable to the Printed Wiring Board

Figure 9:
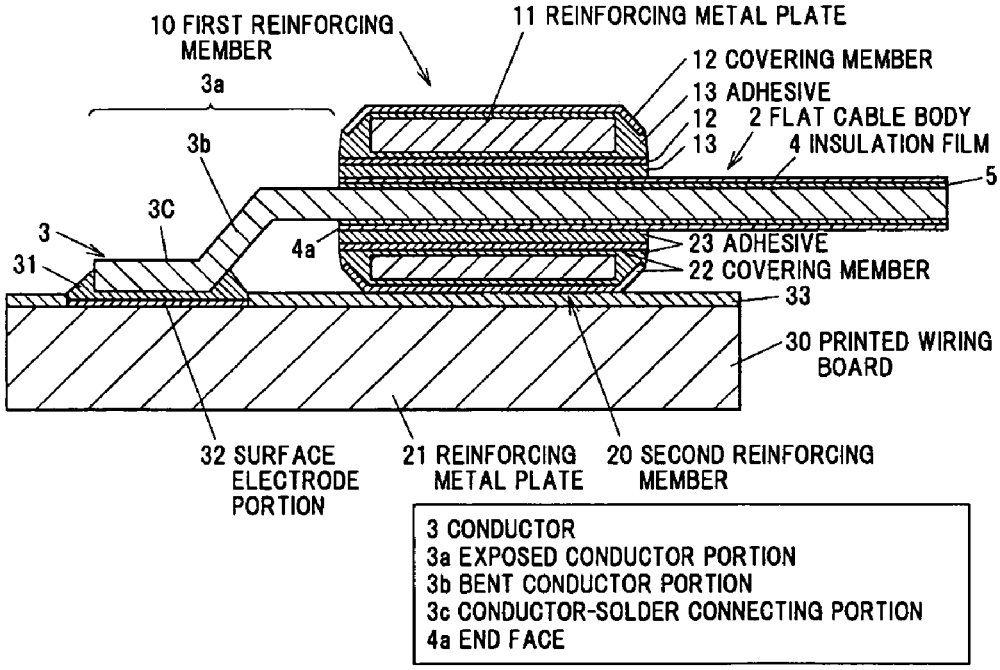
FIG. 9 is a schematic cross sectional view showing a state that the flat cable after the process of FIG. 8E is attached to a printed wiring board.

Next, an example in which the flat cable 1 manufactured as described above is attached to the printed wiring board 30 will be explained with reference to FIGS. 6 and 9. It should be noted that FIGS. 6 and 9 illustrate only one end portion of the flat cable body 2.

For attaching the flat cable 1 to the printed wiring board 30, firstly, the jointing materials 31 and 35 such as paste solder material are applied to the surface electrode section 32 and the through-hole electrode 34 of the printed wiring board 30 by a printing method using a metal mask or a dispensing method. Next, the metal plate insertion portion 11*c* of the first reinforcing member 10 of the flat cable body 2 is positioned with respect to the through-hole electrode 34, and the conductor-solder connecting portion 3*c* of the conductor 3 of the flat cable body 2 is positioned with respect to the surface electrode section 32.

Following this, the conductor-solder connecting portion 3*c* of the flat cable body 2 on one side is placed on the surface electrode section 32 of the printed wiring board 30, and at the same time, the metal plate insertion portion 11*c* of the flat cable body 2 is inserted into the through-hole 30*a* of the printed wiring board 30. Likewise, the conductor-solder connecting portion 3*c* of the flat cable body 2 on another side is placed on the surface electrode section 32 of the printed wiring board 30, and at the same time, the metal plate insertion portion 11*c* of the flat cable body 2 is inserted into the through-hole 30*a* of the printed wiring board 30.

Next, handling and subsequent conveyance to a belt conveyor of a solder reflow oven are carried out in a state that the both end portions of the flat cable body 2 are respectively placed on a pair of printed wiring boards 30, 30 so as to connect therebetween, and the jointing materials 31 and 35 are molten and solidified while being moved in the reflow oven by the belt conveyor. The conductor-solder connecting portion 3*c* of the flat cable body 2 is joined to the surface electrode section 32 of the printed wiring board 30 by this operation. At the same time, a solder-connecting portion which is the tip portion of the metal plate insertion portion 11*c* of the reinforcing metal plate 11 is joined to the through-hole electrode 34 of the printed wiring board 30.

Effects of the Method of Attaching the Flat Cable to the Printed Wiring Board

In a structure body in which the flat cable body 2 is attached to the printed wiring board 30, static or dynamic mechanical load is applied to a portion of the conductor 3 in the vicinity of the conductor-solder connecting portion 3*c* depending on handling for conveyance or a handling method for mounting on a device during the steps from immediately after attachment to mounting on a device, and the portion in the vicinity of the conductor-solder connecting portion 3*c* may be damaged. In the attachment structure of the flat cable body 2 in the illustrated example, the portion in the vicinity of the conductor-solder connecting portion 3*c* is reinforced by the first reinforcing member 10 and the first reinforcing member 10 is fixed to the printed wiring board 30 to resist against such mechanical load. By employing such a configuration, it is possible to suppress the mechanical load applied to the portion in the vicinity of the conductor-solder connecting portion 3*c*. As a result, it is possible to prevent the portion in the vicinity of the conductor-solder connecting portion 3*c* from being damaged.

In addition, in a structure body in which the flat cable body 2 is attached to the printed wiring board 30, the reinforcing metal plate 11 of the first reinforcing member 10 is bent and the metal plate insertion portion 11*c* as the tip portion thereof is inserted into the through-hole 30*a* of the printed wiring board 30. Due to this configuration, positioning of the conductor-solder connecting portion 3*c* with respect to the surface electrode section 32 of the printed wiring board 30 corresponding thereto can be facilitated and accurate when the flat cable 1 is attached to the printed wiring board 30.

In a conventional connecting method, mechanical load at the conductor-solder connecting portion is reduced by using other members different from the flat cable such as a restricting clip, reinforcing plates for covering both front and back surfaces of a conductor-connecting portion or a screw clamp of fixing plate. The number of parts increases due to use of different members, and a step of attaching a member for reducing mechanical load to the printed wiring board is separately provided in the step of attaching the flat cable to the printed wiring board, which may impede reduction of attachment steps or simplification of the steps.

On the other hand, in the structure body in which the flat cable body 2 is attached to the printed wiring board 30, the first reinforcing member 10 and the second reinforcing member 20 are fixed to the surface of the insulation film 4 by an adhesive material, etc., and is further integrated with the flat cable body 2. By employing such a configuration, it is possible to reduce the number of parts as compared to a conventional cable, and the gap between the surface of the insulation film 4 and the surface of the printed wiring board 30 can be filled with the second reinforcing member 20 at the same time as the step of attaching the flat cable body 2 to the printed wiring board 30. An attachment structure of the robust flat cable 1 to the printed wiring board 30 is obtained in which an increase in the number of steps for attaching the flat cable to printed wiring board 30 is suppressed.

Furthermore, in the structure body in which the flat cable body 2 is attached to the printed wiring board 30, the first reinforcing member 10 traversing across the conductor group composed of the plural conductors 3 in an array direction thereof is provided in the vicinity of the conductor-solder connecting portion 3*c* of the conductor 3 joined to the surface electrode section 32 of the printed wiring board 30, and a portion of the metal plate insertion portion 11*c* of the reinforcing metal plate 11 of the first reinforcing member 10 is fixed to the printed wiring board 30. Since the deformation amount in the vicinity of the conductor-solder connecting portion 3*c* caused by mechanical load applied thereto can be significantly reduced by this configuration, it is possible to suppress stress generated in the conductor 3 of the flat cable body 2 and in the jointing material 31 of the printed wiring board 30.

Furthermore, in the structure body in which the flat cable body 2 is attached to the printed wiring board 30, the second reinforcing member 20 is fixed between the surface of the printed wiring board 30 and the surface of the insulation film 4. Due to this configuration, it is possible to fill physical space (gap) required for the conductor 3 of the flat cable 1 to deform in a thickness direction of the conductor plate and it is possible to fix the flat cable body 2 to the printed wiring board 30. As a result, it is possible to further reduce deformation of the flat cable body 2 generated in the vicinity of the conductor-solder connecting portion 3*c* of the conductor 3.

Furthermore, in the structure body in which the flat cable body 2 is attached to the printed wiring board 30, the conductor 3 exposed at the end of the flat cable 1 is directly connected to the surface electrode section 32 of the printed wiring board 30 via the jointing material 31. Therefore, high resistance against mechanical load such as vibration or impact can be exerted.

Although the flat cable 1 and the connection structure between the flat cable 1 and the printed wiring board 30 of the invention have been described based on the first embodiment, the modifications and the illustrated example, the invention is not to be limited thereto and various kinds of embodiments can be implemented without departing from the gist of the invention. Other embodiments described below can be implemented in the invention.

Second Embodiment

Figure 10:
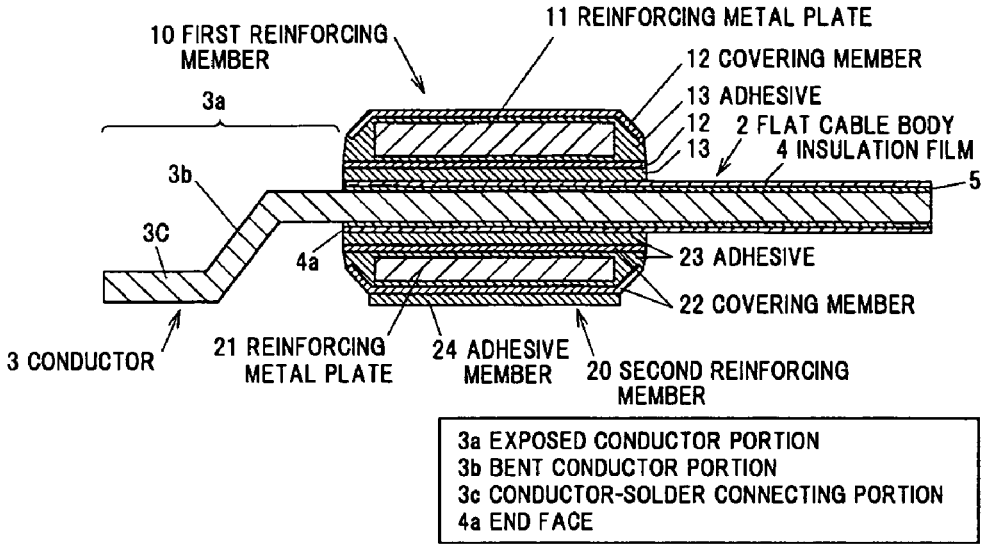
FIG. 10 is a schematic cross sectional view showing a flat cable in a second embodiment.
Figure 11:
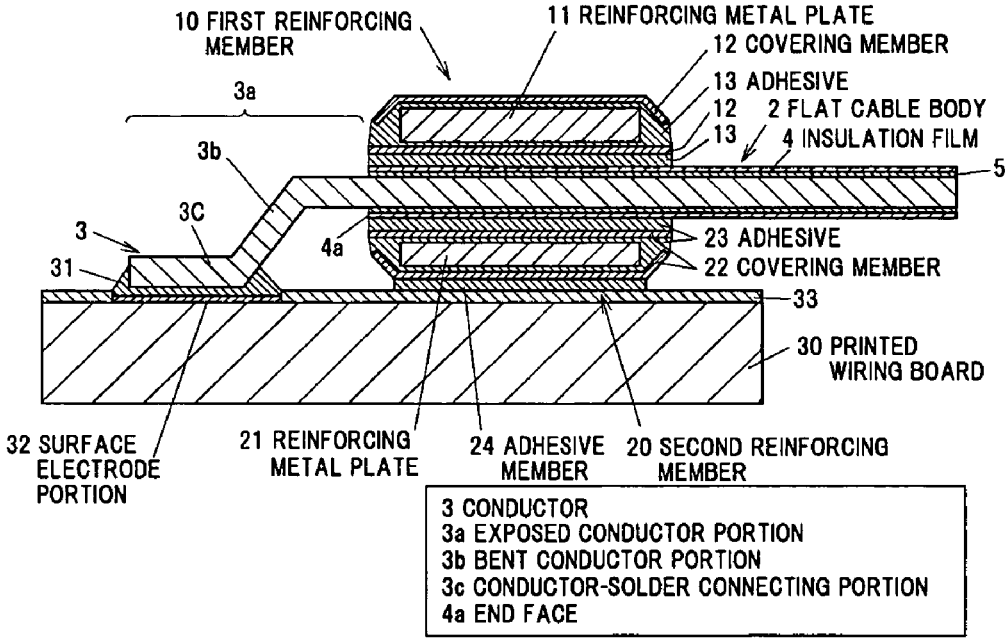
FIG. 11 is a schematic partial cross sectional view showing a state that the flat cable of FIG. 10 is attached to a printed wiring board.

The basic configuration in the second embodiment is not different from the flat cable body 2 and the connection structure between the flat cable body 2 and the printed wiring board 30 in the first embodiment. In FIGS. 10 and 11, a remarkable difference from the first embodiment is that an adhesive member 24 is provided on the covering member 22 on a printed wiring board facing side of the second reinforcing member 20 in the second embodiment while the covering member 22 is provided on the second reinforcing member 20 on a side facing the printed wiring board in the first embodiment.

Note that, members substantially the same as those in the first embodiment are denoted by the same names and reference numerals in FIGS. 10 and 11. Therefore, detailed description thereabout will be omitted. In addition, although only one end portion of the flat cable body 2 is illustrated, the first reinforcing member 10 and the second reinforcing member 20 are also provided at another non-illustrated end portion of the flat cable body 2.

As shown in FIG. 10, the second reinforcing member 20 is provided with the elongated rectangular reinforcing metal plate 21, the covering member 22 for covering the reinforcing metal plate 21 and the adhesive 23 for bonding the reinforcing metal plate 21 to the covering member 22, and an adhesive member 24 is further provided on the covering member 22 located on a side facing the printed wiring board. When the flat cable body 2 is attached to the printed wiring board 30, a surface of the second reinforcing member 20 facing the printed wiring board is bonded to the printed wiring board 30 via the adhesive member 24, as shown in FIG. 11.

The adhesive member 24 is composed of, e.g., a base material formed of polyimide film and an adhesive formed on the both surfaces thereof, or is formed of only an adhesive layer without base material. The adhesive layer may be formed of the same material as the adhesive 23, and it is possible to use, e.g., a material such as epoxy resin, acrylic resin or silicone resin.

Effects of the Second Embodiment

Also in the second embodiment, the first reinforcing member 10 is provided on the flat cable body 2 on a side not facing the printed wiring board 30, and the tip portion of the metal plate insertion portion 11*c* which is a portion of the reinforcing metal plate 11 of the first reinforcing member 10 is joined to the through-hole 30*a* of the printed wiring board 30 via jointing material 31 in the same manner as the first embodiment. This configuration allows the vibratile deformation of the conductor 3 in the vicinity of the conductor-solder connecting portion 3*c* to be suppressed by the first reinforcing member 10 which is provided on the flat cable body 2 in the vicinity of the edge face 4*a* of the insulation film 4, and concentration of high stress to be dispersed.

In combination with this configuration, the flat cable body 2 is fixed to the printed wiring board 30 more firmly by bonding the second reinforcing member 20 to the printed wiring board 30 using the adhesive member 24, and the vibratile deformation of the flat cable body 2 in the vicinity of the conductor-solder connecting portion 3*c* is thus further restricted by the printed wiring board 30.

Since the second reinforcing member 20 is bonded to both the flat cable body 2 and the printed wiring board 30, mechanical load acting on the conductor-solder connecting portion 3*c* of the conductor 3 can be restricted in a large area and the effect of suppressing deformation is thus improved. As a result, it is possible to further suppress the vibratile deformation in the vicinity of the conductor-solder connecting portion 3*c* and it is possible to obtain the flat cable 1 in which stress generated in the vicinity of the conductor-solder connecting portion 3*c* at the upper portion or in the exposed conductor portion 3*a* in the vicinity of the edge face 4*a* of the insulation film 4 is suppressed. It should be noted that it is obvious that, in addition to the effect of the second embodiment, the same effect as the first embodiment is obtained.

Third Embodiment

The basic configuration in the third embodiment is not different from the flat cable body 2 and the connection structure between the flat cable body 2 and the printed wiring board 30 in the first embodiment. In FIGS. 12A to 12D and 13, a remarkable difference from the first embodiment is that the covering member 22 on the reinforcing metal plate 21 on a printed wiring board facing side of the second reinforcing member 20 is eliminated in the third embodiment while the covering member 22 is provided on the reinforcing metal plate 21 on the printed wiring board facing side of the second reinforcing member 20 in the first embodiment.

Note that, members substantially the same as those in the first embodiment are denoted by the same names and reference numerals in FIGS. 12A to 12D and 13. In addition, although only one end portion of the flat cable body 2 is illustrated, the first reinforcing member 10 and the second reinforcing member 20 are also provided at another non-illustrated end portion of the flat cable body 2. Therefore, detailed description thereabout will be omitted.

Figure 12A:
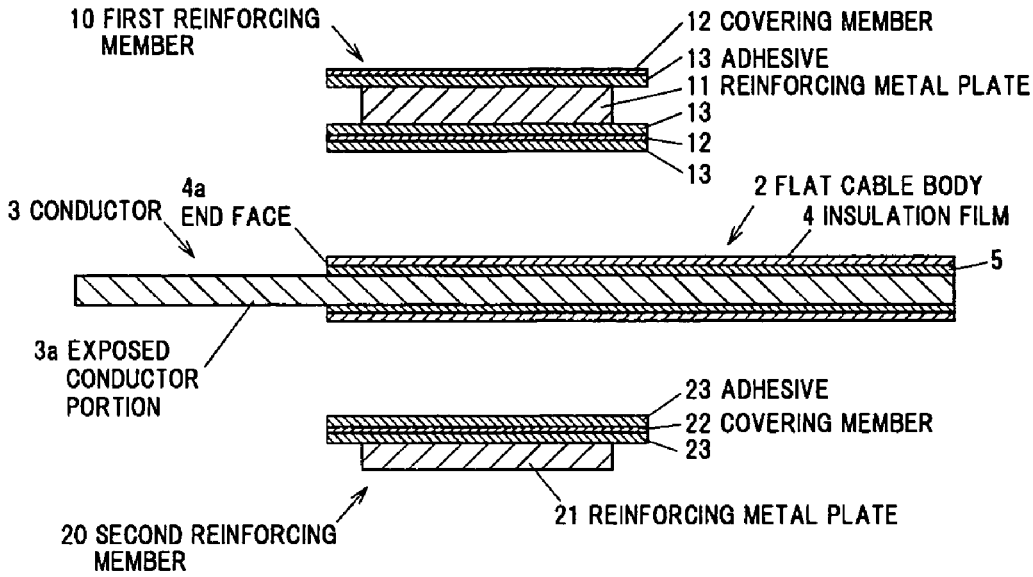
FIG. 12A is a schematic cross sectional view showing a process of manufacturing the flat cable in a third embodiment.

In the second reinforcing member 20, the surface of the reinforcing metal plate 21 on a side facing the printed wiring board is exposed, as shown in FIG. 12A. The second reinforcing member 20 is laminated on the flat cable body 2 in a state of being temporarily bonded thereto via the adhesive 23, as shown in FIG. 12B.

Figure 12B:
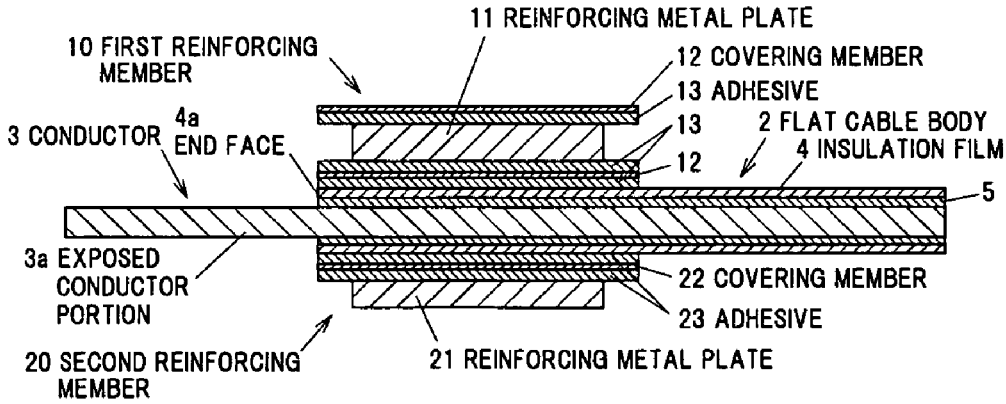
FIG. 12B is a cross sectional view showing a process following FIG. 12A.

The flat cable body 2, the first reinforcing member 10 and the second reinforcing member 20 are laminated in a state that the first reinforcing member 10 is placed on the upper surface of the flat cable body 2 and the second reinforcing member 20 on the lower surface of the flat cable body 2, and are temporarily bonded by the adhesives 13 and 23, as shown in FIG. 12B. The first reinforcing member 10 and the second reinforcing member 20 are arranged so as to be flush with the edge face 4*a* of the insulation film 4 of the flat cable body 2.

Figure 12C:
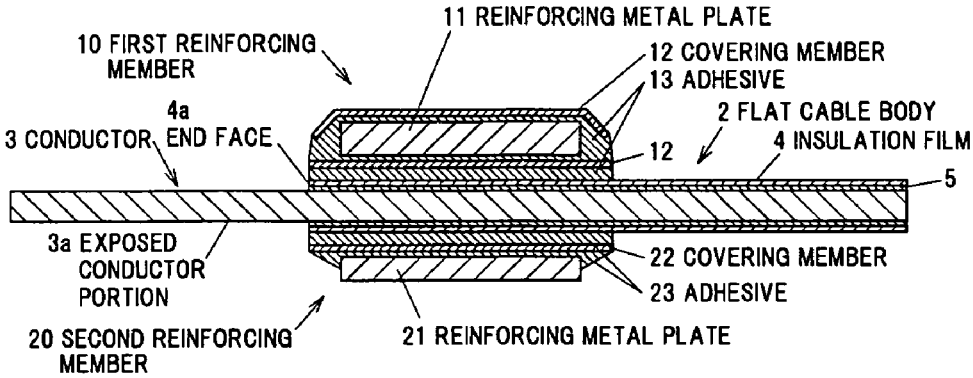
FIG. 12C is a cross sectional view showing a process following FIG. 12B.
Figure 12D:
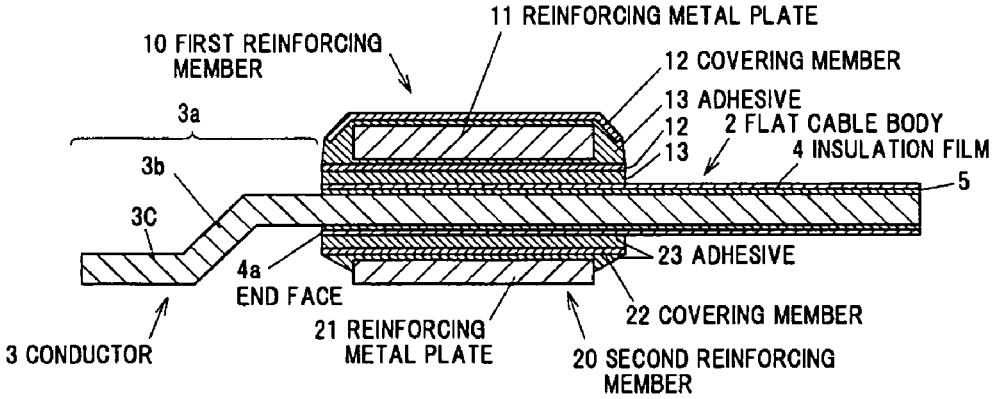
FIG. 12D is a side view showing a process following FIG. 12C.

The flat cable body 2, the first reinforcing member 10 and the second reinforcing member 20 are laminated and integrally formed by applying pressure in a vertical direction thereof by heat pressing, as shown in FIG. 12C. The adhesives 5, 13 and 23 are cured by performing heat treatment. Punching is performed on the flat cable body 2 to trim the external shape thereof into a predetermined shape.

The exposed conductor portion 3*a* of the conductor 3 exposed from the edge face 4*a* of the insulation film 4 of the flat cable body 2 is bent into a predetermined shape, thereby forming the conductor bent portion 3*b* and the conductor-solder connecting portion 3*c*. The reinforcing metal plate 11 of the first reinforcing member 10 is also bent into a predetermined shape, thereby forming the metal plate bent portion 11*b* and the metal plate insertion portion 11*c*. As a result, the flat cable 1 is obtained.

Figure 13:
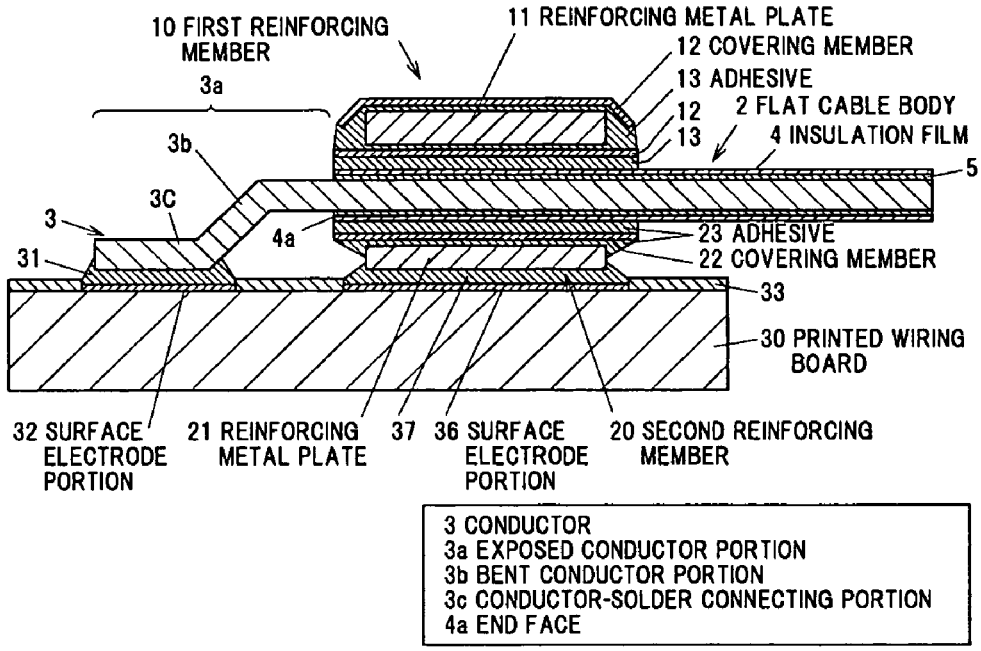
FIG. 13 is a schematic cross sectional view showing a state that the flat cable after the process of FIG. 12D is attached to a printed wiring board.

FIG. 13 illustrates an example in which the flat cable body 2 manufactured as described above is attached to the printed wiring board 30.

A printed wiring board facing surface of the reinforcing metal plate 21 of the second reinforcing member 20 which is exposed from the adhesive 23 is joined to a corresponding surface electrode section 36 of the printed wiring board 30 by a jointing material 37 such as solder material. The reinforcing metal plate 21 of the second reinforcing member 20 is joined to the surface electrode section 36 of the printed wiring board 30 at the same time as and by the same reflow heating as the joining of the exposed conductor portion 3*a* of the conductor 3 to the surface electrode section 32 and the joining of the metal plate insertion portion 11*c* of the first reinforcing member 10 to the through-hole electrode 34 of the printed wiring board 30.

Effects of the Third Embodiment

In addition to the effect of the first embodiment, the third embodiment also has the following effect. In the third embodiment, since the printed wiring board facing surface of the reinforcing metal plate 21 is exposed from the second reinforcing member 20 arranged on the flat cable body 2 in the vicinity of the edge face 4*a* of the insulation film 4 and is joined to the surface electrode section 36 of the printed wiring board 30, it is possible to restrict and fix the flat cable body 2 to the printed wiring board 30 more firmly. As a result, the vibratile deformation of the flat cable body 2 in the vicinity of the conductor-solder connecting portion 3*c* can be suppressed more effectively, and the flat cable 1 in which stress generated in the conductor-solder connecting portion 3*c* at the upper portion or in the exposed conductor portion 3*a* exposed from the edge face 4*a* of the insulation film 4 is suppressed is effectively obtained.

Since the covering member 22 on a side facing the printed wiring board is eliminated from the reinforcing metal plate 21 of the second reinforcing member 20, it is possible to reduce the height (or thickness) of the conductor-solder connecting portion 3*c* after attachment to the printed wiring board 30. This facilitates downsizing and thinning of a device which mounts the cable.

The first reinforcing member 10 and the second reinforcing member 20 which suppress the vibratile deformation of the flat cable body 2 in the vicinity of the conductor-solder connecting portion 3*c* are integrated with the flat cable body 2 by using conventional steps of manufacturing a flat cable. As a result, it is possible to attach the flat cable body 2 to the printed wiring board 30 by one reflow step, and it is possible to simplify the attachment step.

Fourth Embodiment

The basic configuration of the fourth embodiment is not different from the flat cable body 2 and the connection structure between the flat cable body 2 and the printed wiring board 30 in the first embodiment. In FIGS. 14A to 14D, a remarkable difference from the first embodiment is that the reinforcing metal plate 21 of the second reinforcing member 20 is eliminated and a covering member 25 as an example of the second reinforcing member is provided in the fourth embodiment while the covering members 22, 22 are provided on the reinforcing metal plate 21 of the second reinforcing member 20 on a side facing the printed wiring board as well as on a side not facing the printed wiring board in the first embodiment.

Note that, members substantially the same as those in the first embodiment are denoted by the same names and reference numerals in FIGS. 14A to 14D. Therefore, detailed description thereabout will be omitted. In addition, although only one end portion of the flat cable body 2 is illustrated also in the fourth embodiment, the first reinforcing member 10 and the second reinforcing member 20 are also provided at another non-illustrated end portion of the flat cable body 2.

Figure 14A:
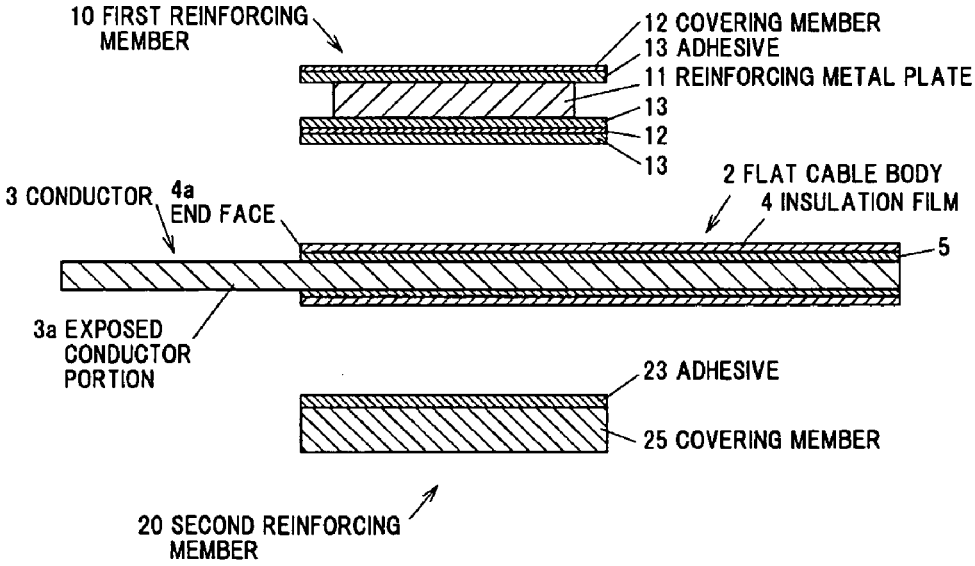
FIG. 14A is a schematic cross sectional view showing a process of manufacturing the flat cable in a fourth embodiment.
Figure 14B:
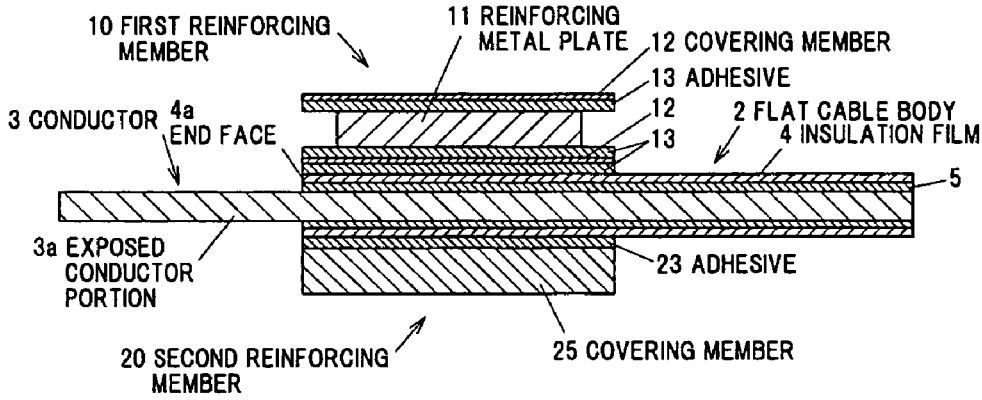
FIG. 14B is a cross sectional view showing a process following FIG. 14A.
Figure 14C:
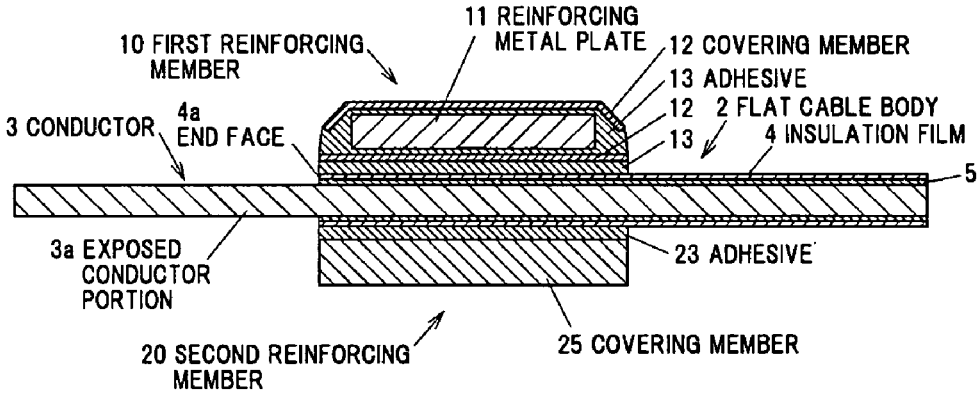
FIG. 14C is a cross sectional view showing a process following FIG. 14B.
Figure 14D:
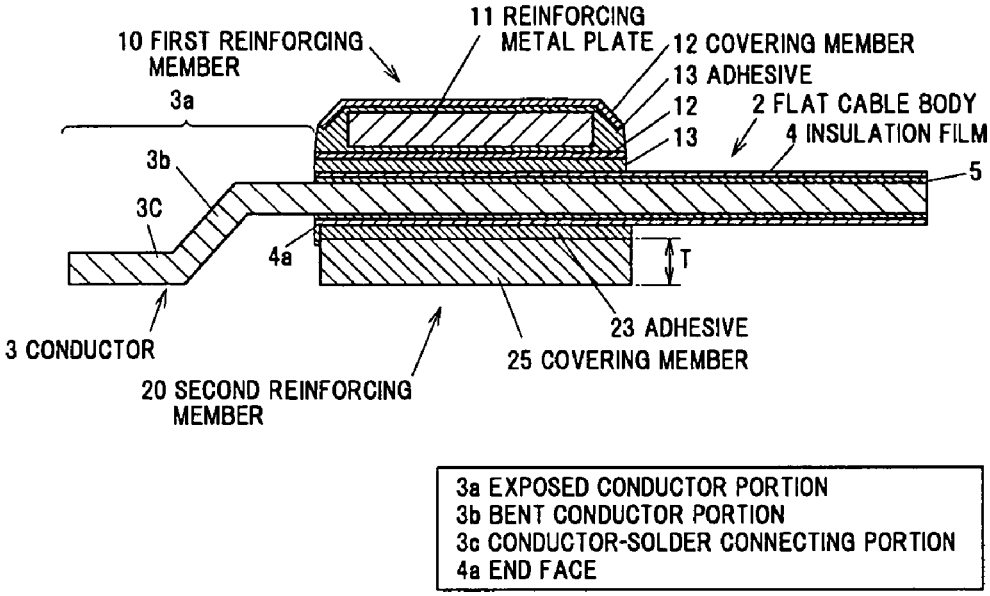
FIG. 14D is a side view showing a process following FIG. 14C.

According to the fourth embodiment, a thickness T of the covering member 25 is preferably larger than the covering member 12 of the first reinforcing member 10, etc., e.g., 0.05 to 0.1 mm, so that a surface of the conductor-solder connecting portion 3*c* facing the printed wiring board is substantially flush with a printed wiring board facing surface of the covering member 25 of the second reinforcing member 20, as shown in FIG. 14D. As a result, the covering member 25 has rigidity greater than the covering member 12 of the first reinforcing member 10. Similarly to the insulation film 4 of the flat cable body 2, a polyimide film having relatively high rigidity and heat resistance is used for the covering member 25.

As shown in FIG. 14A, the second reinforcing member 20 is composed of the adhesive 23 and the covering member 25. The adhesive 23 is applied to a surface of the second reinforcing member 20 facing the flat cable body.

The flat cable body 2, the first reinforcing member 10 and the second reinforcing member 20 are laminated in a state that the first reinforcing member 10 is placed on the upper surface of the flat cable body 2 and the second reinforcing member 20 on the lower surface of the flat cable body 2, and are temporarily bonded by the adhesives 13 and 23, as shown in FIG. 14B. The first reinforcing member 10 and the second reinforcing member 20 are arranged so as to be flush with the edge face 4*a* of the insulation film 4 of the flat cable body 2.

The flat cable body 2, the first reinforcing member 10 and the second reinforcing member 20 are laminated and integrally formed by applying pressure in a vertical direction thereof by heat pressing, as shown in FIG. 14C. The adhesives 5, 13 and 23 are cured by performing heat treatment. Punching is performed on the flat cable body 2 to trim the external shape thereof into a predetermined shape.

In FIG. 14D, the exposed conductor portion 3*a* exposed from the edge face 4*a* of the insulation film 4 of the flat cable body 2 is bent into a predetermined shape, thereby forming the conductor bent portion 3*b* and the conductor-solder connecting portion 3*c*. The reinforcing metal plate 11 of the first reinforcing member 10 is also bent into a predetermined shape, thereby forming the metal plate bent portion 11*b* and the metal plate insertion portion 11*c*. As a result, the flat cable 1 is obtained.

Effects of the Fourth Embodiment

In the fourth embodiment, since the second reinforcing member 20 formed of a high-rigidity film material, which is provided at substantially the same position as the first reinforcing member 10 and fills the gap between the flat cable body 2 and the printed wiring board 30, is provided on the flat cable body 2 in the vicinity of the edge face 4*a* of the insulation film 4, deformation of the flat cable body 2 toward the printed wiring board can be suppressed. In addition to the effect of suppressing deformation and the effect of restricting deformation by joining the metal plate insertion portion 11*c* provided on the first reinforcing member 10 to the through-hole 30*a*, it is possible to reduce deformation of the conductor 3 in the vicinity of the conductor-solder connecting portion 3*c*, and a connection structure between the robust flat cable body 2 and a printed board is obtained.

Since the first reinforcing member 10 and the second reinforcing member 20 which suppress the vibratile deformation of the flat cable body 2 in the vicinity of the conductor-solder connecting portion 3*c* are integrated with the flat cable body 2 by using conventional steps of manufacturing a flat cable, it is possible to attach the flat cable body 2 to the printed wiring board 30 by one reflow step and it is possible to simplify the attachment step. It should be noted that it is obvious that the same effect as the first embodiment is also obtained in the fourth embodiment.

As obvious from the above description, it should be noted that not all combinations of the features described in the embodiments, the modifications and the illustrated examples are not necessary to solve the problem of the invention, and it is obvious that various configurations can be made within the technical idea of the invention.

What is claimed is:

1. A flat cable, comprising:

a plurality of conductors arranged in parallel;

an insulating member covering the plurality of conductors;

a first reinforcing member on a surface of an end portion of the insulating member; and a second reinforcing member on an opposite side of the first reinforcing member across the conductor and the insulating member, wherein the first reinforcing member comprises a reinforcing metal plate comprising an end portion bent toward the second reinforcing member, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member, and wherein the second reinforcing member has a rigidity greater than that of the covering member of the first reinforcing member.

2. The flat cable according to claim 1, wherein the second reinforcing member comprises a covering member thicker than the covering member of the first reinforcing member, and an adhesive interposed between the covering member of the second reinforcing member and the insulating member to bond therebetween.

3. The flat cable according to claim 1, wherein the reinforcing metal plate of the first reinforcing member is thicker than the conductor.

4. The flat cable according to claim 1, wherein an end portion of the reinforcing metal plate of the first reinforcing member comprises a tapered shape or an arc shape.

5. The flat cable according to claim 1, wherein the second reinforcing member comprises a reinforcing metal plate, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member.

6. The flat cable according to claim 5, wherein the reinforcing metal plate of the second reinforcing member is thinner than the reinforcing metal plate of the first reinforcing member.

7. A connection structure between a flat cable and a printed wiring board, comprising:

a flat cable; and a printed wiring board, wherein the flat cable comprises:

a plurality of conductors arranged in parallel;

an insulating member covering the plurality of conductors;

a first reinforcing member on a surface of an end portion of the insulating member so as to fix both end portions of the plurality of conductors to the printed wiring board; and a second reinforcing member on a opposite side of the first reinforcing member across the conductor and the insulating member, the second reinforcing member being fixed to the printed wiring board, wherein the first reinforcing member comprises a reinforcing metal plate comprising an end portion bent toward the second reinforcing member, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member, wherein the second reinforcing member has a rigidity greater than that of the covering member of the first reinforcing member, and wherein the plurality of conductors are connected at both end portions thereof to corresponding electrodes of the printed wiring board.

8. The connection structure according to claim 7, wherein the second reinforcing member comprises a covering member thicker than the covering member of the first reinforcing member, and an adhesive interposed between the covering member of the second reinforcing member and the insulating member to bond therebetween.

9. The connection structure according to claim 7, wherein the reinforcing metal plate of the first reinforcing member is thicker than the conductor.

10. The connection structure according to claim 7, wherein an end portion of the reinforcing metal plate of the first reinforcing member comprises a tapered shape or an arc shape.

11. The connection structure according to claim 7, wherein the second reinforcing member comprises a reinforcing metal plate, a covering member covering at least a portion of a periphery of the reinforcing metal plate, and an adhesive interposed between the reinforcing metal plate and the covering member and between the covering member and the insulating member to bond the reinforcing metal plate to the covering member and the covering member to the insulating member.

12. The connection structure according to claim 11, wherein the reinforcing metal plate of the second reinforcing member is thinner than the reinforcing metal plate of the first reinforcing member.

* * * * *